US011867034B2

(12) United States Patent
Jaaskelainen et al.

(10) Patent No.: US 11,867,034 B2
(45) Date of Patent: Jan. 9, 2024

(54) SYSTEMS AND METHODS FOR AUTOMATED GAS LIFT MONITORING

(71) Applicant: HALLIBURTON ENERGY SERVICES, INC., Houston, TX (US)

(72) Inventors: Mikko K. Jaaskelainen, Houston, TX (US); Shahab Jamali Ghare Tape, Houston, TX (US); Kashyap Navinchand Choksey, Sugar Land, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 38 days.

(21) Appl. No.: 17/350,593

(22) Filed: Jun. 17, 2021

(65) Prior Publication Data

US 2022/0403721 A1 Dec. 22, 2022

(51) Int. Cl.
*E21B 43/12* (2006.01)
*E21B 47/113* (2012.01)

(52) U.S. Cl.
CPC ..... *E21B 43/123* (2013.01); *E21B 47/114* (2020.05)

(58) Field of Classification Search
CPC ..... E21B 43/123; E21B 47/114
See application file for complete search history.

(56) References Cited

U.S. PATENT DOCUMENTS 5,458,200 A * 10/1995 Lagerlef ..... E21B 43/123 166/372
6,873,267 B1 * 3/2005 Tubel ..... E21B 43/12 166/250.15
8,290,632 B2 * 10/2012 Briers ..... E21B 43/12 700/285
2004/0108118 A1 6/2004 Williams
2005/0149264 A1 * 7/2005 Tarvin ..... G01K 11/32 374/E11.015
2008/0202763 A1 * 8/2008 Lafferty ..... E21B 43/122 166/372
2010/0082258 A1 4/2010 Wang
2012/0046866 A1 * 2/2012 Meyer ..... E21B 28/00 702/6
2012/0111104 A1 5/2012 Taverner et al.
2016/0061003 A1 * 3/2016 Gottumukkala ..... E21B 34/16 166/50
2016/0208605 A1 7/2016 Morrow et al.
2020/0190964 A1 6/2020 Romer et al.
2021/0047916 A1 * 2/2021 Thiruvenkatanathan ..... E21B 47/135
2022/0145734 A1 * 5/2022 Al Hashim ..... E21B 43/122
2022/0381143 A1 * 12/2022 Cerrahoglu ..... G01H 9/004

OTHER PUBLICATIONS

International Search Report and Written Opinion for PCT Application No. PCT/US2021/039414 dated Mar. 10, 2022, 9 pages.

* cited by examiner

*Primary Examiner* — D. Andrews
(74) *Attorney, Agent, or Firm* — NOVAK DRUCE CARROLL LLP

(57) ABSTRACT

A method is provided. Sensor data regarding a wellbore is received from at least one of a distributed fiber optic sensing line positioned along the wellbore and a plurality of subsurface and surface sensors. Flow models are generated based on the sensor data to optimize production flow. Flow profiles are generated based on the flow models and the sensor data to adjust at least one gas lift valve.

24 Claims, 21 Drawing Sheets

SYSTEMS AND METHODS FOR AUTOMATED GAS LIFT MONITORING

TECHNICAL FIELD

The present technology pertains to optimizing production flow monitoring, and more particularly, to optimizing gas lift monitoring using in-situ developed flow and production models.

BACKGROUND

Accurate production monitoring flow models are very difficult to develop due to a number of reasons ranging from differences between well and reservoir properties, production depletion over time, drilling and wellbore related effects from well-to-well, and flow loop test facility limitations in terms of noise environment and scale. These are aspects that have been very difficult to address using conventional technology.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
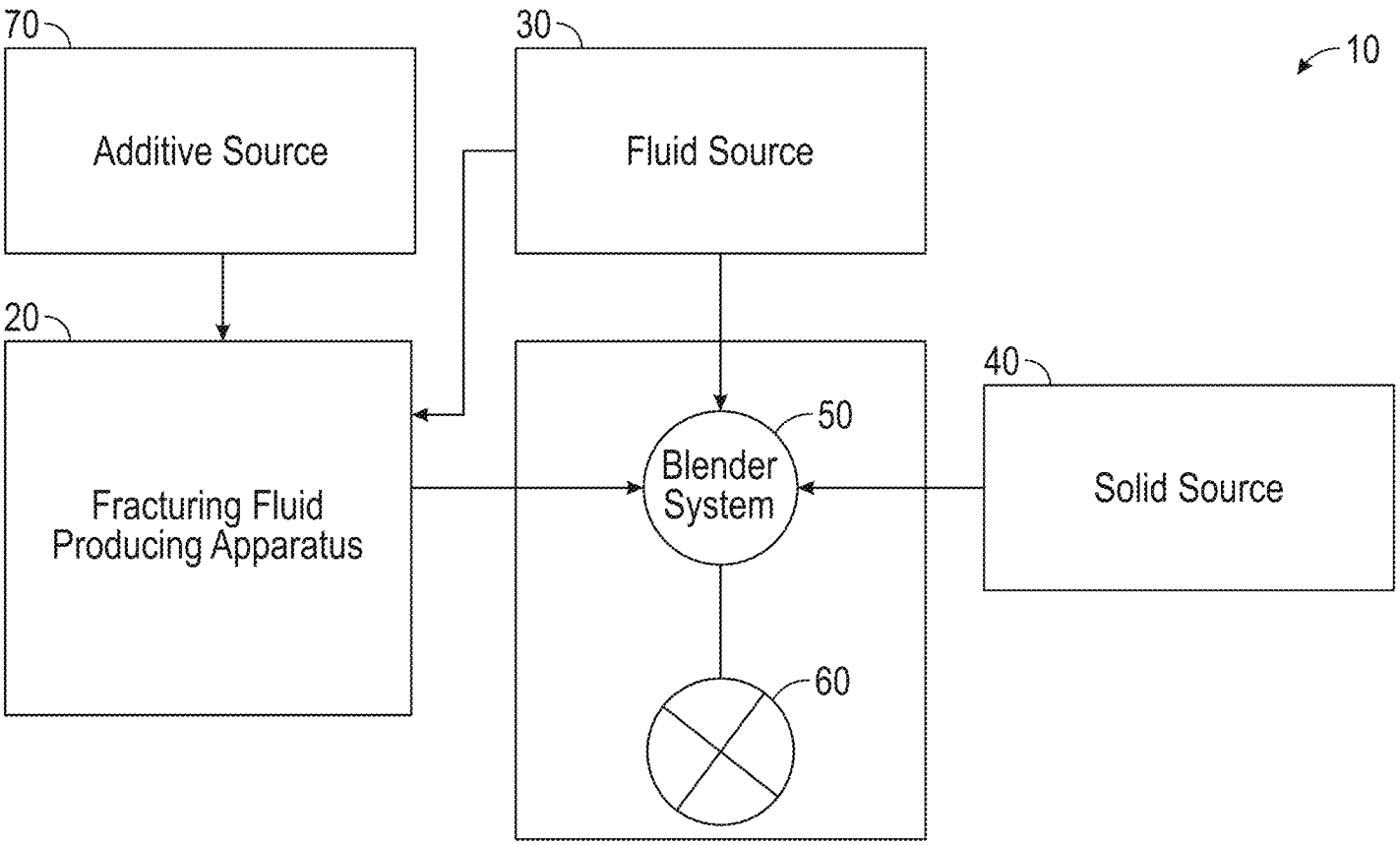
FIG. 1 illustrates a schematic diagram of an example fracturing system, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Some wellbores flow naturally while some wellbores require gas lift to assist in optimizing production. Optimizing gas-lift valve operations is crucial to maximize the hydrocarbon production from a wellbore. When a wellbore is fitted with a string of gas lift valves as a form of artificial lift, some problems can emerge hindering the operations of the gas lift valves leading to a suboptimal liquid yield on the surface. Problems such as the wrong opening sequence or valves open/close at a pressure different than their preset pressures are examples of those challenges. Some wellbore surveillance techniques can be employed, in order to identify, and then mitigate those issues.

Distributed Fiber Optic Sensing (DFOS) optionally coupled with downhole pressure gauges are cost effective techniques that can be installed in wells to monitor the gas lift valves operations and give clear and concise information regarding the state of each valve. The temperature and acoustic data captured by a Distributed Temperature Sensing (DTS) box and Distributed acoustic sensing (DAS) box connected to a fiber optic cable installed behind the production tubing of a well can be used to identify the state of a gas lift valve whether it is open or closed or malfunctioning (e.g., leaking). As the liquid flow from the reservoir to the surface, it has a certain temperature that can be logged by the DTS system. Once a gas lift valve opens and gas is injected into the tubing, a cooling effect takes place, as the gas passes through the orifice. This cooling effect is known as Joule Thompson effect. The DTS can capture the change in temperature with great accuracy in terms of temperature and depth nearly in real time. Similarly, the DAS system can record acoustic signals and strain effects on the optical fiber from the gas and/or fluid as the gas passes through the orifice. The DAS system can sample the data at 10 khz sample rate or even higher frequencies depending on fiber length, and the data can be processed to show amplitude and frequency content of the flowing gas lift valve and any other acoustic or strain events along the fiber.

In various embodiments, a method for optimizing production flow monitoring by utilizing data driven in-situ injection. The method can include receiving sensor data from at least one of a distributed fiber optic sensing line positioned along a wellbore and a plurality of subsurface and surface sensors. The method can also include generating flow models based on the sensor data received from the at least one of the distributed fiber optic sensing line and the plurality of subsurface and surface sensors to optimize production flow. The method can further include generating flow profiles based on the flow models and the sensor data received from the at least one of the distributed fiber optic sensing line and the plurality of subsurface and surface sensors to adjust gas flow valves.

In various embodiments, a system for optimizing production flow monitoring by utilizing data driven in-situ injection can include one or more processors and at least one computer-readable storage medium having stored therein instructions which, when executed by the one or more processors, cause the system to receive sensor data from at least one of a distributed fiber optic sensing line positioned along a wellbore and a plurality of subsurface and surface sensors. The instructions can further cause the system to generate flow models based on the sensor data received from the at least one of the distributed fiber optic sensing line and the plurality of subsurface and surface sensors to optimize production flow. The instructions can also cause the system to generate flow profiles based on the flow models and the sensor data received from the at least one of the distributed fiber optic sensing line and the plurality of subsurface and surface sensors to adjust zonal inflow device.

In various embodiments, a non-transitory computer-readable storage medium comprising instructions stored the non-transitory computer-readable storage medium, the instructions, when executed by one or more processors, cause the one or more processors to receive sensor data from at least one of a distributed fiber optic sensing line positioned along a wellbore and a plurality of subsurface and surface sensors. The instructions can further cause the one or more processors to generate flow models based on the sensor data received from the at least one of the distributed fiber optic sensing line and the plurality of subsurface and surface sensors to optimize production flow and/or gas lift valve operation. The instructions can also cause the one or more processors to generate flow profiles based on the flow models and the sensor data received from the at least one of the distributed fiber optic sensing line and the plurality of subsurface and surface sensors to adjust operation of gas lift valve(s) and/or replace malfunctioning gas lift valve(s).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Referring to FIG. 1, an example fracturing system 10 is shown. The example fracturing system 10 shown in FIG. 1 can be implemented using the systems, methods, and techniques described herein. In particular, the disclosed system, methods, and techniques may directly or indirectly affect one or more components or pieces of equipment associated with the example fracturing system 10, according to one or more embodiments. The fracturing system 10 includes a fracturing fluid producing apparatus 20, a fluid source 30, a solid source 40, and a pump and blender system 50. All or an applicable combination of these components of the fracturing system 10 can reside at the surface at a well site/fracturing pad where a well 60 is located.

During a fracturing job, the fracturing fluid producing apparatus 20 can access the fluid source 30 for introducing/controlling flow of a fluid, e.g. a fracturing fluid, in the fracturing system 10. While only a single fluid source 30 is shown, the fluid source 30 can include a plurality of separate fluid sources. Further, the fracturing fluid producing apparatus 20 can be omitted from the fracturing system 10. In turn, the fracturing fluid can be sourced directly from the fluid source 30 during a fracturing job instead of through the intermediary fracturing fluid producing apparatus 20.

The fracturing fluid can be an applicable fluid for forming fractures during a fracture stimulation treatment of the well 60. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 60. In certain embodiments, the fracturing fluid can include a gel pre-cursor with fluid, e.g. liquid or substantially liquid, from fluid source 30. Accordingly, the gel pre-cursor with fluid can be mixed by the fracturing fluid producing apparatus 20 to produce a hydrated fracturing fluid for forming fractures.

The solid source 40 can include a volume of one or more solids for mixture with a fluid, e.g. the fracturing fluid, to form a solid-laden fluid. The solid-laden fluid can be pumped into the well 60 as part of a solids-laden fluid stream that is used to form and stabilize fractures in the well 60 during a fracturing job. The one or more solids within the solid source 40 can include applicable solids that can be added to the fracturing fluid of the fluid source 30. Specifically, the solid source 40 can contain one or more proppants for stabilizing fractures after they are formed during a fracturing job, e.g. after the fracturing fluid flows out of the formed fractures. For example, the solid source 40 can contain sand.

The fracturing system 10 can also include additive source 70. The additive source 70 can contain/provide one or more applicable additives that can be mixed into fluid, e.g. the fracturing fluid, during a fracturing job. For example, the additive source 70 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. The additives can function to maintain solid particle suspension in a mixture of solid particles and fracturing fluid as the mixture is pumped down the well 60 to one or more perforations.

The pump and blender system 50 functions to pump fracture fluid into the well 60. Specifically, the pump and blender system 50 can pump fracture fluid from the fluid source 30, e.g. fracture fluid that is received through the fracturing fluid producing apparatus 20, into the well 60 for forming and potentially stabilizing fractures as part of a fracture job. The pump and blender system 50 can include one or more pumps. Specifically, the pump and blender system 50 can include a plurality of pumps that operate together, e.g. concurrently, to form fractures in a subterranean formation as part of a fracturing job. The one or more pumps included in the pump and blender system 50 can be an applicable type of fluid pump. For example, the pumps in the pump and blender system 50 can include electric pumps and/or hydrocarbon and hydrocarbon mixture powered pumps. Specifically, the pumps in the pump and blender system 50 can include diesel powered pumps, natural gas powered pumps, and diesel combined with natural gas powered pumps.

The pump and blender system 50 can also function to receive the fracturing fluid and combine it with other components and solids. Specifically, the pump and blender system 50 can combine the fracturing fluid with volumes of solid particles, e.g. proppant, from the solid source 40 and/or additional fluid and solids from the additive source 70. In turn, the pump and blender system 50 can pump the resulting mixture down the well 60 at a sufficient pumping rate to create or enhance one or more fractures in a subterranean zone, for example, to stimulate production of fluids from the zone. While the pump and blender system 50 is described to perform both pumping and mixing of fluids and/or solid particles, in various embodiments, the pump and blender system 50 can function to just pump a fluid stream, e.g. a fracture fluid stream, down the well 60 to create or enhance one or more fractures in a subterranean zone.

The fracturing fluid producing apparatus 20, fluid source 30, and/or solid source 40 may be equipped with one or more monitoring devices (not shown). The monitoring devices can be used to control the flow of fluids, solids, and/or other compositions to the pumping and blender system 50. Such monitoring devices can effectively allow the pumping and blender system 50 to source from one, some or all of the different sources at a given time. In turn, the pumping and blender system 50 can provide just fracturing fluid into the well at some times, just solids or solid slurries at other times, and combinations of those components at yet other times.

Figure 2:
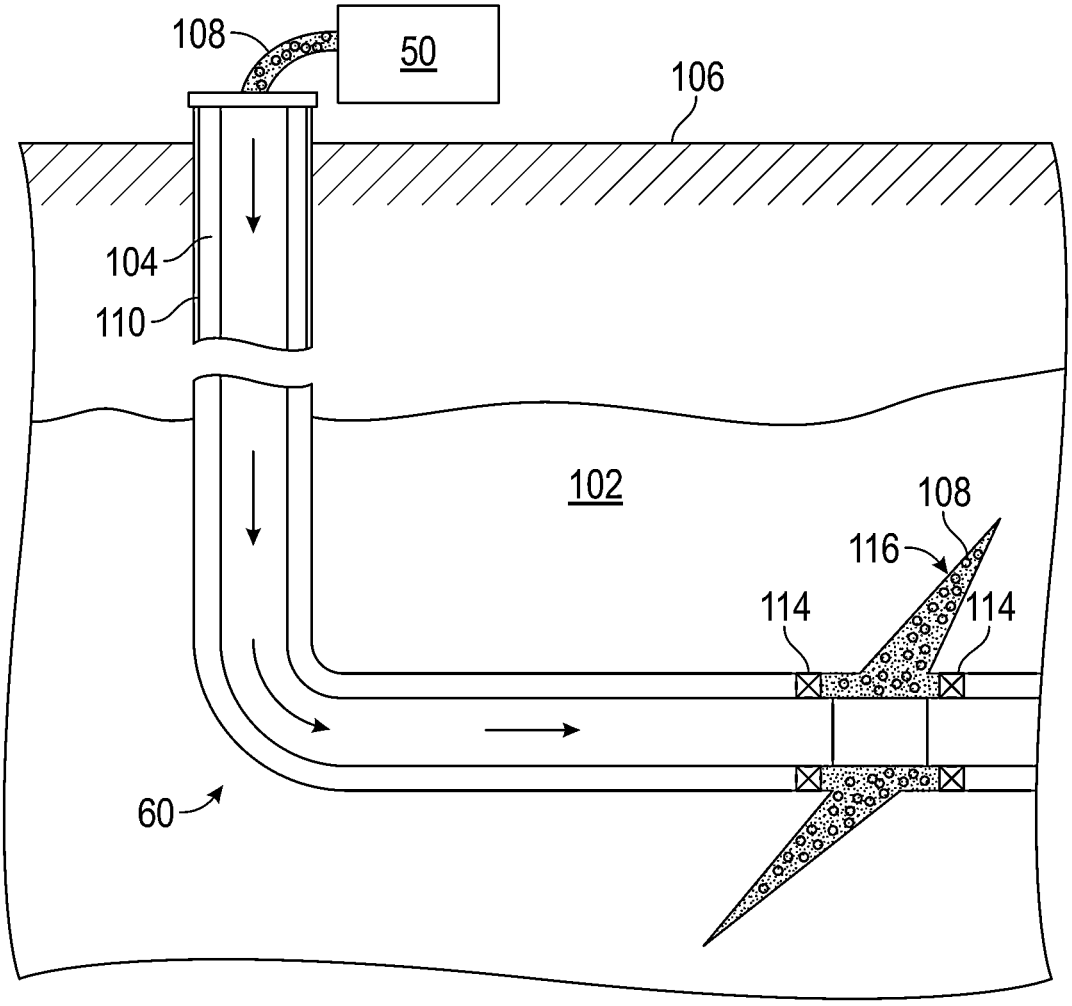
FIG. 2 illustrates a well during a fracturing operation in a portion of a subterranean formation of interest surrounding a wellbore, in accordance with aspects of the present disclosure.

FIG. 2 shows the well 60 during a fracturing operation in a portion of a subterranean formation of interest 102 surrounding a wellbore 104. The fracturing operation can be performed using one or an applicable combination of the components in the example fracturing system 10 shown in FIG. 1. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 may include horizontal, vertical, slant, curved, and other types of wellbore geometries and orientations, and the fracturing treatment may be applied to a subterranean zone surrounding any portion of the wellbore 104. The wellbore 104 can include a casing 110 that is cemented or otherwise secured to the wellbore wall. The wellbore 104 can be uncased or otherwise include uncased sections. Perforations can be formed in the casing 110 to allow fracturing fluids and/or other materials to flow into the subterranean formation 102. As will be discussed in greater detail below, perforations can be formed in the casing 110 using an applicable wireline-free actuation or a wireline that deploys perforation guns. In the example fracture operation shown in FIG. 2, a perforation is created between points 114.

The pump and blender system 50 is fluidly coupled to the wellbore 104 to pump the fracturing fluid 108, and potentially other applicable solids and solutions into the wellbore 104. When the fracturing fluid 108 is introduced into wellbore 104 it can flow through at least a portion of the wellbore 104 to the perforation, defined by points 114. The fracturing fluid 108 can be pumped at a sufficient pumping rate through at least a portion of the wellbore 104 to create one or more fractures 116 through the perforation and into the subterranean formation 102. Specifically, the fracturing fluid 108 can be pumped at a sufficient pumping rate to create a sufficient hydraulic pressure at the perforation to form the one or more fractures 116. Further, solid particles, e.g. proppant from the solid source 40, can be pumped into the wellbore 104, e.g. within the fracturing fluid 108 towards the perforation. In turn, the solid particles can enter the fractures 116 where they can remain after the fracturing fluid flows out of the wellbore. These solid particles can stabilize or otherwise "prop" the fractures 116 such that fluids can flow freely through the fractures 116.

While only two perforations at opposing sides of the wellbore 104 are shown in FIG. 2, as will be discussed in greater detail below, greater than two perforations can be formed in the wellbore 104, e.g. along the top side of the wellbore 104, as part of a perforation cluster. Fractures can then be formed through the plurality of perforations in the perforation cluster as part of a fracturing stage for the perforation cluster. Specifically, fracturing fluid and solid particles can be pumped into the wellbore 104 and pass through the plurality of perforations during the fracturing stage to form and stabilize the fractures through the plurality of perforations.

Figure 3:
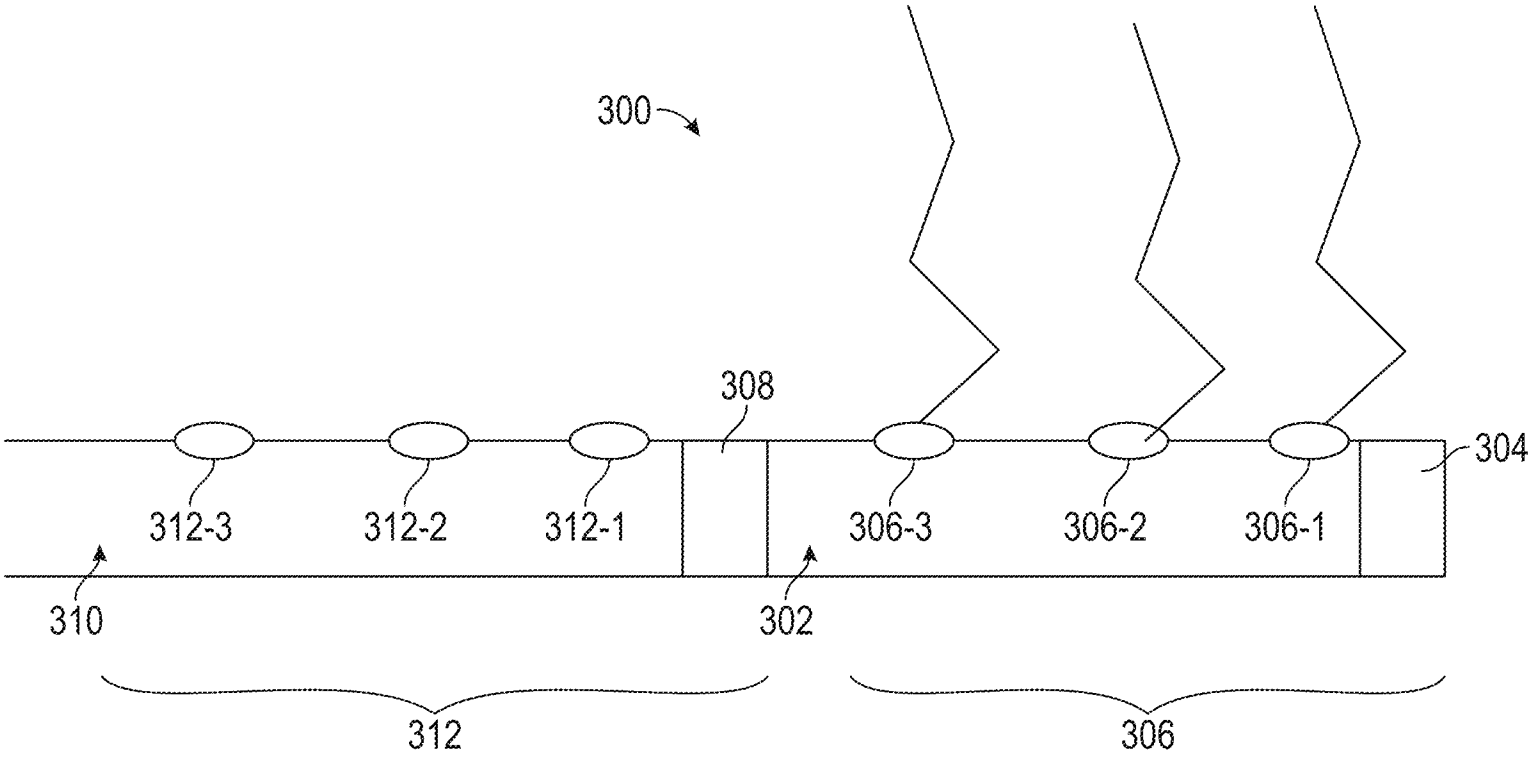
FIG. 3 illustrates a portion of a wellbore that is fractured using multiple fracture stages, in accordance with aspects of the present disclosure.

FIG. 3 shows a portion of a wellbore 300 that is fractured using multiple fracture stages. Specifically, the wellbore 300 is fractured in multiple fracture stages using a plug-and-perf technique.

The example wellbore 300 includes a first region 302 within a portion of the wellbore 300. The first region 302 can be positioned in proximity to a terminal end of the wellbore 300. The first region 302 is formed within the wellbore 300, at least in part, by a plug 304. Specifically, the plug 304 can function to isolate the first region 302 of the wellbore 300 from another region of the wellbore 300, e.g. by preventing the flow of fluid from the first region 302 to another region of the wellbore 300. The region isolated from the first region 302 by the plug 304 can be the terminal region of the wellbore 300. Alternatively, the region isolated from the first region 302 by the plug 304 can be a region of the wellbore 300 that is closer to the terminal end of the wellbore 300 than the first region 302. While the first region 302 is shown in FIG. 3 to be formed, at least in part, by the plug 304, in various embodiments, the first region 302 can be formed, at least in part, by a terminal end of the wellbore 300 instead of the plug 304. Specifically, the first region 302 can be a terminal region within the wellbore 300.

The first region 302 includes a first perforation 306-1, a second perforation 306-2, and a third perforation 306-3. The first perforation 306-1, the second perforation 306-2, and the third perforation 306-3 can form a perforation cluster 306 within the first region 302 of the wellbore 300. While three perforations are shown in the perforation cluster 306, in various embodiments, the perforation cluster 306 can include fewer or more perforations. As will be discussed in greater detail later, fractures can be formed and stabilized within a subterranean formation through the perforations 306-1, 306-2, and 306-3 of the perforation cluster 306 within the first region 302 of the wellbore 300. Specifically, fractures can be formed and stabilized through the perforation cluster 306 within the first region 302 by pumping fracturing fluid and solid particles into the first region 302 and through the perforations 306-1, 306-2, and 306-3 into the subterranean formation.

The example wellbore 300 also includes a second region 310 positioned closer to the wellhead than the first region 302. Conversely, the first region 302 is in closer proximity to a terminal end of the wellbore 300 than the second region 310. For example, the first region 302 can be a terminal region of the wellbore 300 and therefore be positioned closer to the terminal end of the wellbore 300 than the second region 310. The second region 310 is isolated from the first region 302 by a plug 308 that is positioned between the first region 302 and the second region 310. The plug 308 can fluidly isolate the second region 310 from the first region 302. As the plug 308 is positioned between the first and second regions 302 and 310, when fluid and solid particles are pumped into the second region 310, e.g. during a fracture stage, the plug 308 can prevent the fluid and solid particles from passing from the second region 310 into the first region 302.

The second region 310 includes a first perforation 312-1, a second perforation 312-2, and a third perforation 312-3. The first perforation 312-1, the second perforation 312-2, and the third perforation 312-3 can form a perforation cluster 312 within the second region 310 of the wellbore 300. While three perforations are shown in the perforation cluster 312, in various embodiments, the perforation cluster 312 can include fewer or more perforations. As will be discussed in greater detail later, fractures can be formed and stabilized within a subterranean formation through the perforations 312-1, 312-2, and 312-3 of the perforation cluster 312 within the second region 310 of the wellbore 300. Specifically, fractures can be formed and stabilized through the perforation cluster 312 within the second region 310 by pumping fracturing fluid and solid particles into the second region 310 and through the perforations 312-1, 312-2, and 312-3 into the subterranean formation.

In fracturing the wellbore 300 in multiple fracturing stages through a plug-and-perf technique, the perforation cluster 306 can be formed in the first region 302 before the second region 310 is formed using the plug 308. Specifically, the perforations 306-1, 306-2, and 306-3 can be formed before the perforations 312-1, 312-2, and 312-3 are formed in the second region 310. The perforations 306-1, 306-2, and 306-3 can be formed using a wireline-free actuation. Once the perforations 306-1, 306-2, and 306-3 are formed, fracturing fluid and solid particles can be transferred through the wellbore 300 into the perforations 306-1, 306-2, and 306-3 to form and stabilize fractures in the subterranean formation as part of a first fracturing stage. The fracturing fluid and solid particles can be transferred from a wellhead of the wellbore 300 to the first region 302 through the second region 310 of the wellbore 300. Specifically, the fracturing fluid and solid particles can be transferred through the second region 310 before the second region 310 is formed, e.g. using the plug 308, and the perforation cluster 312 is formed. This can ensure, at least in part, that the fracturing fluid and solid particles flow through the second region 310 and into the subterranean formation through the perforations 306-1, 306-2, and 306-3 within the perforation cluster 306 in the first region 302.

After the fractures are formed through the perforations 306-1, 306-2, and 306-3, the wellbore 300 can be filled with the plug 308. Specifically, the wellbore 300 can be plugged with the plug 308 to form the second region 310. Then, the perforations 312-1, 312-2, and 312-3 can be formed, e.g. using a wireline-free actuation. Once the perforations 312-1, 312-2, and 312-3 are formed, fracturing fluid and solid particles can be transferred through the wellbore 300 into the perforations 312-1, 312-2, and 312-3 to form and stabilize fractures in the subterranean formation as part of a second fracturing stage. The fracturing fluid and solid particles can be transferred from the wellhead of the wellbore 300 to the second region 310 while the plug 308 prevents transfer of the fluid and solid particles to the first region 302. This can effectively isolate the first region 302 until the first region 302 is accessed for production of resources, e.g. hydrocarbons. After the fractures are formed through the perforation cluster 312 in the second region 310, a plug can be positioned between the second region 310 and the wellhead, e.g. to fluidly isolate the second region 310. This process of forming perforations and forming fractures during a fracture stage, followed by plugging on a region by region basis can be repeated. Specifically, this process can be repeated up the wellbore towards the wellhead until a completion plan for the wellbore 300 is finished.

Figure 4:
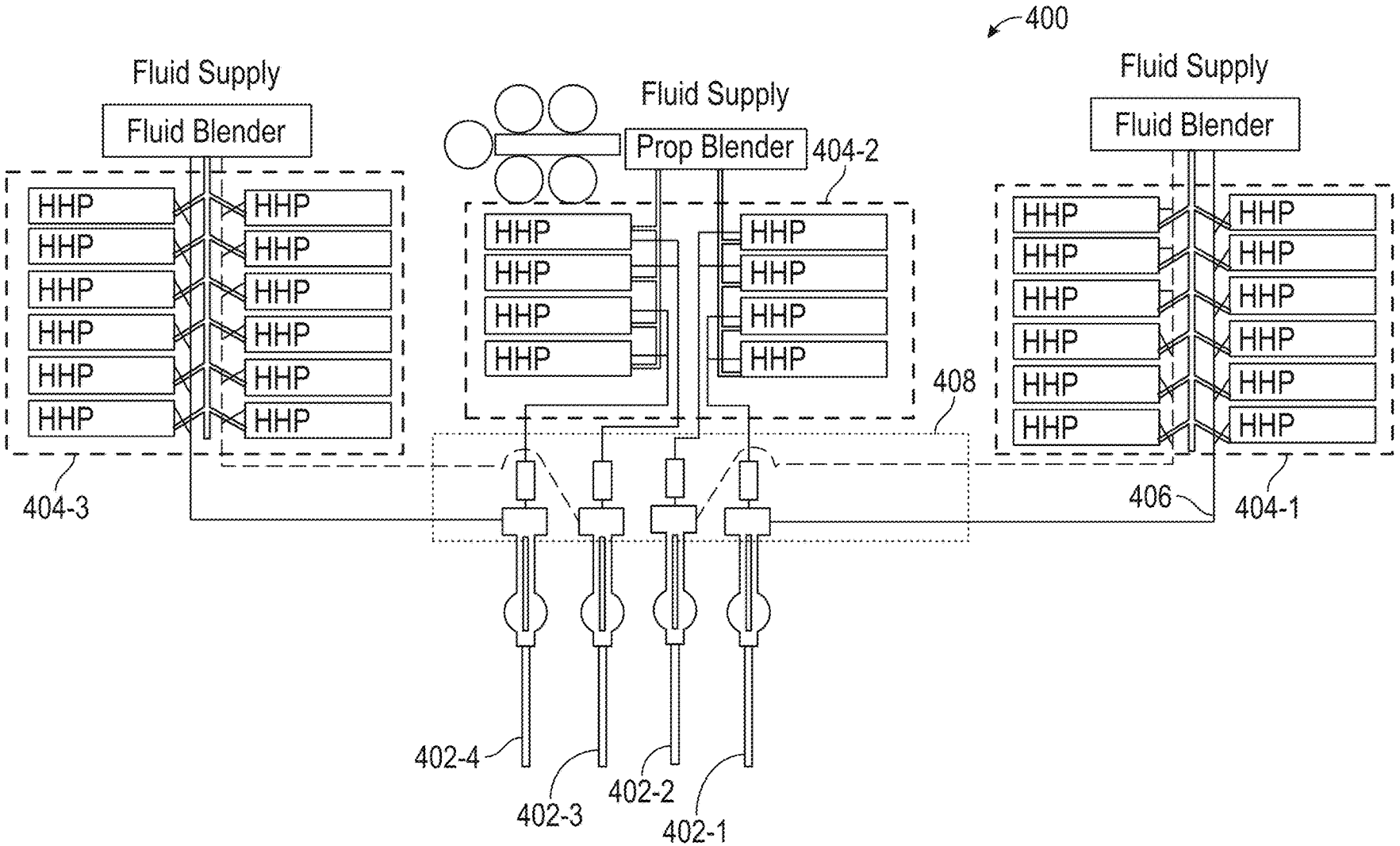
FIG. 4 illustrates an example fracturing system for concurrently performing fracturing stages in multiple wellbores, in accordance with aspects of the present disclosure.

FIG. 4 shows an example fracturing system 400 for concurrently performing fracturing stages in multiple wellbores. The example fracturing system 400 can be implemented using one or an applicable combination of the components shown in the example fracturing system 10 shown in FIG. 1. Further, the example fracturing system 400 can form fractures according to the example techniques implemented in the well 60 shown in FIG. 2 and the wellbore 300 shown in FIG. 3.

The example fracturing system 400 includes a first wellbore 402-1, a second wellbore 402-2, a third wellbore 402-3, and a fourth wellbore 402-4, collectively referred to as the wellbores 402. While four wellbores 402 are shown, the fracturing system 400 can include three or two wellbores, as long as the fracturing system 400 includes more than one wellbore. Further, the fracturing system 400 can include more than four wellbores.

The example fracturing system 400 also includes a first pump 404-1, a second pump 404-2, and a third pump 404-3, collectively referred to as a pumping system 404. While the pumping system is shown as including three separate pumps, the pumping system 404 can include fewer than three pumps or more than three pumps. For example, the pumping system 404 can include only a single pump. In some implementations, the first pump 404-1 can include a set of pumps where each block (HHP) can be one pump. Fluid coupling 406 (e.g., indicated by the solid line 406) can couple the six pumps (HHP) on the right side that feed fluid to the first wellbore 402-1. The second pump 404-2 can add proppant to the mix and be supported by the two lower right HHP blocks/pumps to the first well 402-1. In some examples, the fracturing system 400 can include eight sets of pumps that are correspondingly coupled to the four wellbores 402-1, 402-2, 402-3, 402-4. The pumping system 404 can also include three sets of pumps, where the first pump 404-1 includes two sets of pumps and the third pump 404-3 includes two sets of pumps that share a common fluid blender. The second pump 404-2 can include four sets of pumps that share a common proppant blender. In another example, eight sets of pumps can support four sets of wells, where each well is supported by one fluid pump set and one proppant pump set.

The pumping system 404 is fluidly connected to each of the wellbores 402. Specifically, the pumping system 404 can be fluidly connected to each of the wellbores 402, at least in part, through one or more fluid couplings, e.g. fluid coupling 406. In being fluidly connected to each of the wellbores 402, the pumping system 404 can pump fracturing fluid and solid particles, e.g. proppant, into the wellbores 402 for forming and stabilizing fractures through the wellbores 402. Specifically, the pumping system 404 can pump fracturing fluid and solid particles into the wellbores 402 for forming and stabilizing fractures through passages and/or perforations in the wellbores 402. The pumping system 404 can pump fracturing fluid into the wellbores 402 for forming fractures in the wellbores 402 according to the previously described plug-and-perf technique. Further, the pumping system 404 can pump solid particles, e.g. proppant, in a solid-laden fluid stream into the wellbores 402 for stabilizing the fractures according to the previously described plug-and-perf technique. In being fluidly connected to each of the wellbores 402, the pumping system 404 can pump additional components, e.g. additives, into the wellbores 402 for aiding in the formation and/or stabilization of fractures in the wellbores 402.

Figure 5:
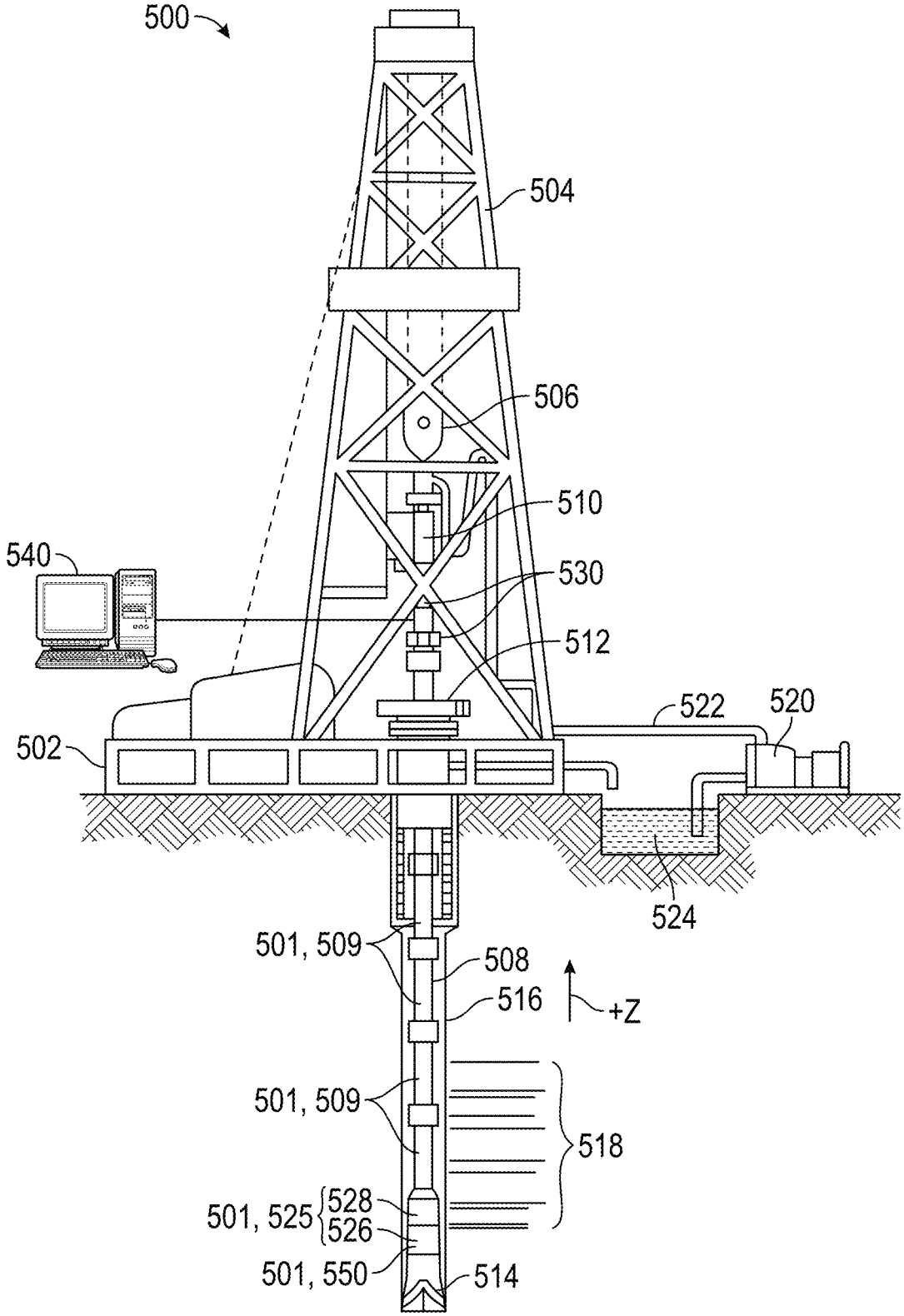
FIG. 5 illustrates an example diagram of an environment in which a drilling system may be used, in accordance with aspects of the present disclosure.

FIG. 5 illustrates a diagrammatic view of an example wellbore drilling environment 500, for example, a logging while drilling (LWD) and/or measurement while drilling (MWD) wellbore environment, in which the present disclosure may be implemented. As illustrated in FIG. 5, a drilling platform 502 is equipped with a derrick 504 that supports a hoist 506 for raising and lowering one or more drilling components 501 which can include, for example, a drill string 508 which can include one or more drill collars 509, a drill bit 514, and/or a bottom-hole assembly 525. The drilling components 501 are operable to drill a wellbore 516. The drilling components 501 also can include housings for one or more downhole tools. The drilling components 501 include at least one material having an actual yield strength. The actual yield strength can be determined and/or provided by the manufacturer of the drilling components 501. For example, the material of the drilling components 501 can be non-magnetic. In some examples, the material of the drilling components 501 can be stainless steel.

The hoist 506 suspends a top drive 510 suitable for rotating the drill string 508 and lowering the drill string 508 through the well head 512. Connected to the lower end of the drill string 508 is a drill bit 514. As the drill bit 514 rotates, the drill bit 514 creates a wellbore 516 that passes through various formations 518. A pump 520 circulates drilling fluid through a supply pipe 522 to top drive 510, down through the interior of drill string 508, through orifices in drill bit 514, back to the surface via the annulus around drill string 508, and into a retention pit 524. The drilling fluid transports cuttings from the wellbore 516 into the pit 524 and aids in maintaining the integrity of the wellbore 516. Various materials can be used for drilling fluid, including oil-based fluids and water-based fluids.

Referring to FIG. 5, sensors 526 can be provided, for example integrated into the bottom-hole assembly 525 near the drill bit 514. As the drill bit 514 extends the wellbore 516 through the formations 518, the sensors 526 can collect measurements of various drilling parameters, for example relating to various formation properties, the orientation of the drilling component(s) 501, dog leg severity, pressure, temperature, weight on bit, torque on bit, and/or rotations per minute. The sensors 526 can be any suitable sensor to measure the drilling parameters, for example transducers, fiber optic sensors, and/or surface and/or downhole sensors. The bottom-hole assembly 525 may also include a telemetry sub 528 to transfer measurement data to a surface receiver 530 and to receive commands from the surface. In some examples, the telemetry sub 528 communicates with a surface receiver 530 using mud pulse telemetry. In other examples, the telemetry sub 528 does not communicate with the surface, but rather stores logging data for later retrieval at the surface when the logging assembly is recovered. Notably, one or more of the bottom-hole assembly 525, the sensors 526, and the telemetry sub 528 may also operate using a non-conductive cable (e.g. slickline, etc.) with a local power supply, such as batteries and the like. When employing non-conductive cable, communication may be supported using, for example, wireless protocols (e.g. EM, acoustic, etc.) and/or measurements and logging data may be stored in local memory for subsequent retrieval at the surface.

Each of the sensors 526 may include a plurality of tool components, spaced apart from each other, and communicatively coupled with one or more wires. The telemetry sub 528 may include wireless telemetry or logging capabilities, or both, such as to transmit information in real time indicative of actual downhole drilling parameters to operators on the surface.

The sensors 526, for example an acoustic logging tool, may also include one or more computing devices 550 communicatively coupled with one or more of the plurality of drilling components 501. The computing device 550 may be configured to control or monitor the performance of the sensors 526, process logging data, and/or carry out the methods of the present disclosure.

In some examples, one or more of the sensors 526 may communicate with a surface receiver 530, such as a wired drillpipe. In other cases, the one or more of the sensors 526 may communicate with a surface receiver 530 by wireless signal transmission. In at least some cases, one or more of the sensors 526 may receive electrical power from a wire that extends to the surface, including wires extending through a wired drillpipe. In at least some examples the methods and techniques of the present disclosure may be performed by a controller 540, for example a computing device, on the surface. The controller 540 is discussed in further detail below. In some examples, the controller 540 may be included in and/or communicatively coupled with surface receiver 530. For example, surface receiver 530 of wellbore operating environment 500 at the surface may include one or more of wireless telemetry, processor circuitry, or memory facilities, such as to support substantially real-time processing of data received from one or more of the sensors 526. In some examples, data can be processed at some time subsequent to its collection, wherein the data may be stored on the surface at surface receiver 530, stored downhole in telemetry sub 528, or both, until it is retrieved for processing.

As understood by those of skill in the art, machine-learning based classification techniques can vary depending on the desired implementation. For example, machine-learning classification schemes can utilize one or more of the following, alone or in combination: hidden Markov models, recurrent neural networks (RNNs), convolutional neural networks (CNNs); Deep Learning networks, Bayesian symbolic methods, general adversarial networks (GANs), support vector machines, image registration methods, and/or applicable rule-based systems. Where regression algorithms are used, they can include but are not limited to: a Stochastic Gradient Descent Regressors, and/or Passive Aggressive Regressors, etc.

Machine learning classification models can also be based on clustering algorithms (e.g., a Mini-batch K-means clustering algorithm), a recommendation algorithm (e.g., a Minwise Hashing algorithm, or Euclidean Locality-Sensitive Hashing (LSH) algorithm), and/or an anomaly detection algorithm, such as a Local outlier factor. Additionally, machine-learning models can employ a dimensionality reduction approach, such as, one or more of: a Mini-batch Dictionary Learning algorithm, an Incremental Principal Component Analysis (PCA) algorithm, a Latent Dirichlet Allocation algorithm, and/or a Mini-batch K-means algorithm, etc.

Multiphase production profiling can be an essential component of a production management program. A production management program can incorporate multidisciplinary technologies. For example, each production management program can be unique and be designed exclusively for a reservoir of interest. One of the elements of production management can include production optimization. Production optimization can include early identification of inefficiencies when they occur. However, there are factors that can be challenging and hinder efforts to obtain desired results of the production management program. For example, insufficient surveillance data, in a timely manner, can be one of the factors that leads to a less effective production management program.

Production Logging Tools (PLT) can be utilized to address well surveillance in terms of multiphase production profiling. PLT may have limitations that can inhibit their use in some types of wells. Well completion types are an example of such a limitation. In some types of wells, PLT may be unable to be performed due to the complexity of the completion. Another limitation is the well intervention itself, which can pose a health, safety, and environment (HSE) risk. Moreover, the PLT can provide a snapshot of the well condition, as continuous monitoring of the dynamic nature of a well flow regime is not possible, which can introduce a fair degree of uncertainty in the reservoir surveillance data.

The disclosed technology can include continuous production monitoring that can provide several optimization opportunities such as minimizing water production through downhole or surface choking; improving oil/gas recovery through the adjustment of a choke size; identifying inefficient areas that may require improvement (e.g., workover/well intervention); reducing of reservoir water disposal when less water is produced; and reducing the cost associated with periodical PLT runs.

While PLT can deliver useful information relating to production data, the PLT may not be left in the well for a long period of time. In addition, PLT may not continuously measure entire producing intervals as PLT is a point sensor. For example, PLT may not be able to track entire reservoir production sensitivities to different flow regimes that are adjusted at a surface choke or at Interval Control Valves (ICV). Though smart wells are becoming more popular, they are still unable to provide fast manipulation of ICV's that result in production optimization.

Figure 6:
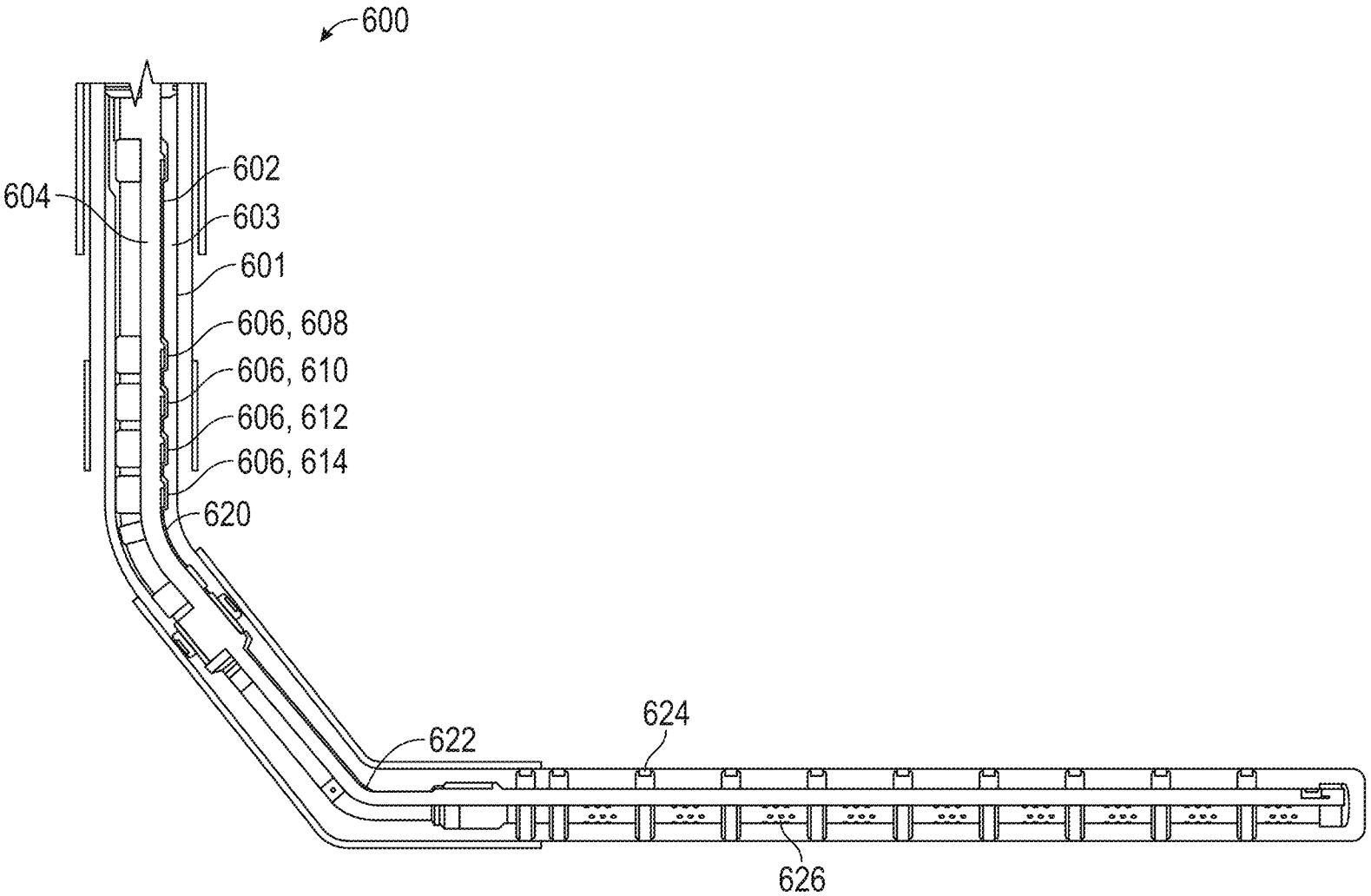
FIG. 6 illustrates an example system with a plurality of gas lift valves, in accordance with aspects of the present disclosure.

FIG. 6 illustrates a system 600 including a tubing 602 disposed in a wellbore 601. An well annulus 603 is formed between the walls of the wellbore 601 and the tubing 602, for example where fluid such as gas, oil, drilling fluid, etc. can be present and/or flow. The tubing 602 can include any suitable conveyance, for example coiled tubing, drill string, and/or production string. The tubing 602 forms a tubing flow area 604 such that fluid or other drilling or production components can pass through. In at least one example, the tubing 602 can include a rupture disc sub. In at least one example, one or more packers 624 can be provided to isolate portions of the wellbore 601, for example by blocking a portion of the wellbore annulus 603 between the tubing 602 and the wellbore 601. In some examples, the tubing 602 can include perforated pipe which can permit fluid communication between the tubing flow area 604 and the wellbore annulus 603.

The tubing 602 can include a plurality of gas lift valves 606 to be used during gas injection operations. Gas injection operations can be performed, for example, from a temporary facility or permanent setup with wells that are currently self-flowing for enhanced production or permanent setup with wells that require gas lift support in order to flow. Gas lift valves can assist in the unloading operation to get a wellbore 601 flowing. All producing wellbores 601 deplete the reservoir pressure as hydrocarbons, and fluids are produced and may benefit from gas lift support at the later stages of the wellbore 601 and reservoir life when the reservoir pressure is lower.

In an example for unloading a wellbore 601, gas can be injected into the wellbore 601 from the annulus 603 to unload the wellbore 601 through tubing 602. Only specific gas lift valves 606 are used for operations, and all the gas lift valves 606 may not be used. An injection operation can be performed at a high rate and high pressure to lift fluid column from the tubing 602 in the wellbore 601. Gas injection is stopped and/or completed once production is achieved and the wellbore 601 starts flowing on its own without the need of any injection.

In an example for artificial lift, gas is continuously injected from the annulus 603. In an artificial lift operation, gas is continuously injected in-order to achieve proper drawdown for optimal production. Operators can start injecting the gas into the annulus 603 and first open the topmost (e.g., the gas lift valve 606 closest to the surface) gas lift valve 608. The next gas lift valve 610 proximate and downhole in relation to the topmost gas lift valve 608 is then opened to operate. The previous gas lift valve 608 is then closed, for example due to a pressure difference and/or by instruction such as activating a motor. In general, only one gas lift valve 606 operates at a time except possibly during the transition between active gas lift valves. While it may be possible to operate multiple gas lift valves 606 simultaneously, the a single gas lift valve 606 can be operated at any given time in order to optimize the gas lift process and use of lift gas. This process will be continuing for each sequential gas lift valve 606 (e.g., gas lift valve 612 and gas lift valve 614) until the final gas lift valve 606 (for example the bottom most gas lift valve 614 or a gas lift valve 606 uphole from the bottom most gas lift valve 614 depending on well and reservoir configuration) operates and gas will be injected for this gas lift valve 606. The final gas lift valve 606 is the gas lift valve 606 disposed furthest downhole while still maintaining the production of the wellbore 601 within a target range. The rest of the plurality of gas lift valves 606 are closed such that only the final gas lift valve 606 is operating.

In some situations, a gas lift valve 606 may be closed due to design error or valve fault and extra gas is injected from an upper gas lift valve 606 and lift gas is wasted without utilization on well production. In some situations, an operator may want to know if they are injecting optimal amount of gas at the operating gas lift valve 606 to know if lift gas is not wasted and utilized in oil production. Optimal injection of gas (e.g., within a target range) needs to be injected for the final gas lift valve 606 to have sustainable production throughout life of well. For this, the operator can utilize one or more surface sensors to measure injection gas and pressure of injection. Once the operator has a record for injection, point of injection, and pressure, the operator can start controlling the rate of injection from the surface to have optimal injection from point of injection and have proper lift. Sometimes a higher gas injection rate is needed more to lift fluid from the wellbore 601 due to specific gravity of crude and reservoir pressure. Optimal injection can be achieved while maintaining the production of the wellbore 601 within a target range. The target range can be predetermined.

The system 600 can include one or more fiber optic cables 620 disposed in the wellbore 601. In some examples, the fiber optic cable 620 can be disposed in, along, and/or on the tubing 602. In some examples, the fiber optic cable 620 can be disposed in the wellbore annulus 603, in casing for the wellbore 603, and/or any other suitable position within the wellbore 601. Fiber optic cables 620 are discussed in more detail in relation to FIG. 19. In some examples, the fiber optic cables 620 can span at least a portion of the wellbore 601. For example, the fiber optic cables 620 can span the entirety of the wellbore 601 from the surface to the end of the wellbore 601. In some examples, the fiber optic cables 620 can span only a portion of the wellbore 601 as desired to obtain measurements and data regarding that portion of the wellbore 601 and/or the system 600. The fiber optic cables 620 can measure, for example, temperature, acoustics, and/or pressure to determine which of the plurality of gas lift valves 606 is operating. In some examples, the fiber optic cables 620 can be utilized to determine whether the production of the wellbore 601 is within a target range and/or how the gas is flowing to lift production of the wellbore 601. Accordingly, the measurements from the fiber optic cables 620 can help determine whether the injection is optimized.

Figure 7B:
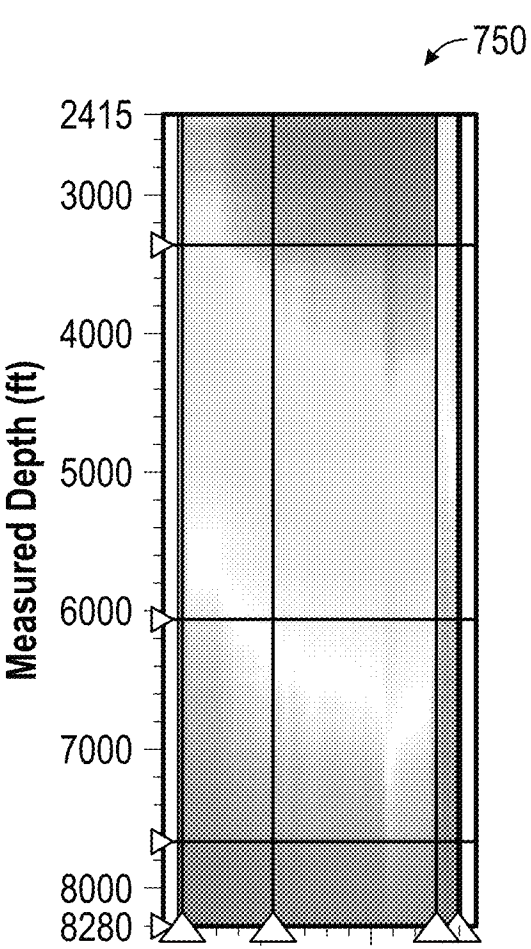
FIGS. 7A and 7B illustrate example temperature measurement from a fiber optic cable in relation to measured depth of the wellbore, in accordance with aspects of the present disclosure.
Figure 7A:
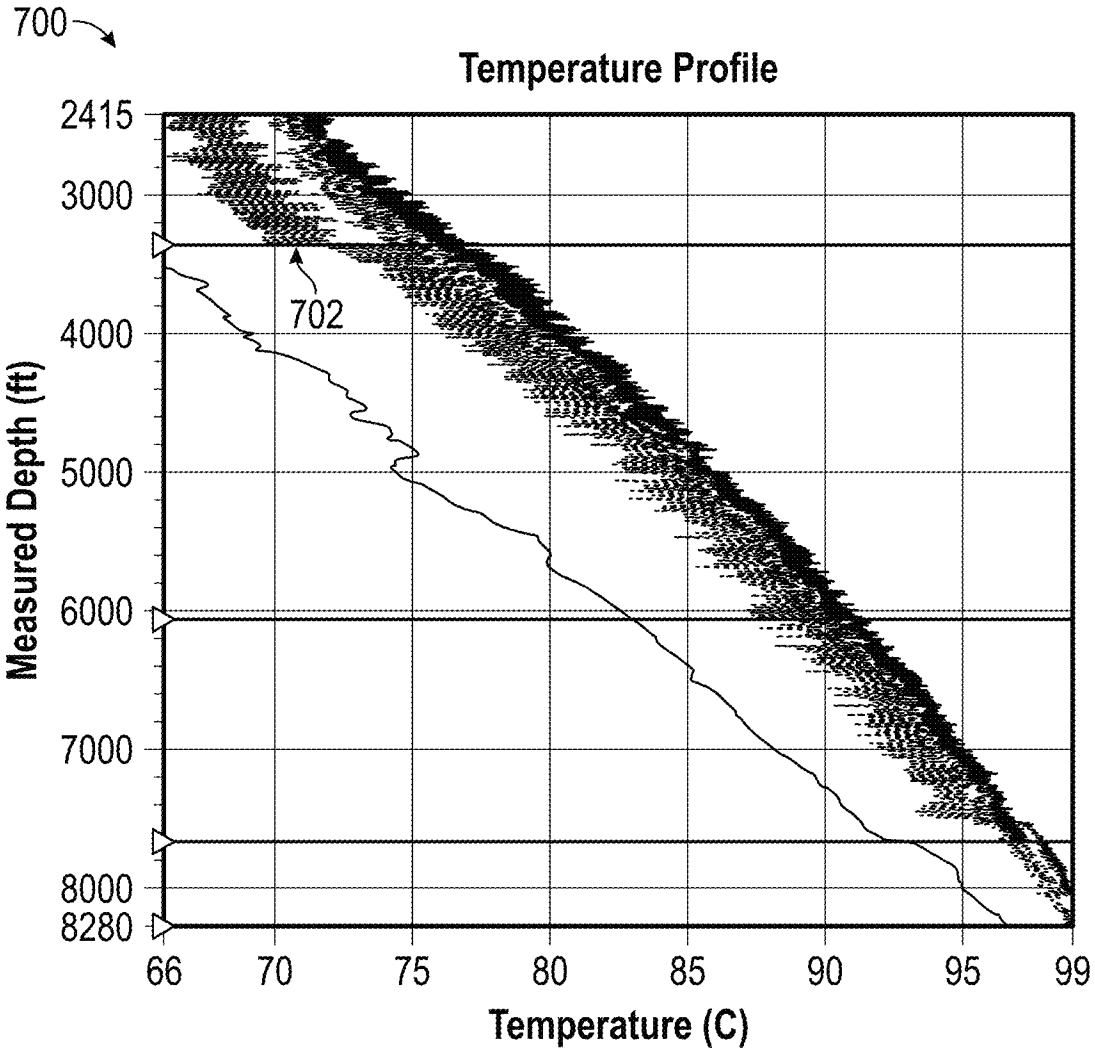

FIGS. 7A and 7B illustrate temperature measurement from a fiber optic cable 620 in relation to measured depth of the wellbore 601. FIG. 7B shows temperature of the wellbore 601 in relation to time and depth. FIG. 7A shows selected temperature traces in line with the temperature measurements in FIG. 7B. Point 702 indicates a temperature shift in the temperature measurements due to the opening of one of the plurality of gas lift valves 606. As shown in FIGS. 7A and 7B, when the gas lift valve 606 is opened, the temperature drops.

In at least one example, wellbores 601 may be produced by letting the wellbores 601 flow naturally as this is the lowest cost production mode where no artificial means are not applied for production. Wellbores 601 and flow lines may be shut down for various reasons and may not flow naturally (e.g. viscosity changes with temperature, momentum) once the surface valves are opened. The wellbores 601 and flow lines may need a boost to start flowing and may flow once warmer fluids are in the tubing 602 and flow lines, and there is a momentum in the system 600.

The wellbores 601 may not have lift gas available at the well site initially and operators may bring in a third party with lift gas in pressurized vessels. The lift gas is then connected to the gas lift system that is preinstalled as a part of the completion string. The wellbores 601 can be put on production using a normal gas lift off-loading process until the lowest (e.g., disposed furthest downhole) gas lift valve 606 is operating when the tubing 602 has more than one gas lift valve 606. Annulus fluid level can be monitored to determine which gas lift valve 606 is operating to minimize use of lift gas once the lowest gas lift valve 606 is operating. For example, the thermal (DTS) and/or acoustic (DAS) measurements deviating from a base line can show the fluid level and subsequently which of the plurality of gas lift valves 606 is operating.

The lift gas is then removed once the wellbore 601 is flowing again and/or reduced to minimize and/or optimize lift gas usage. Monitoring can be done using at least one of the distributed fiber optic sensing line 620 and/or plurality of subsurface and/or surface sensors and rate controlled by gas lift pressure.

Figure 8A:
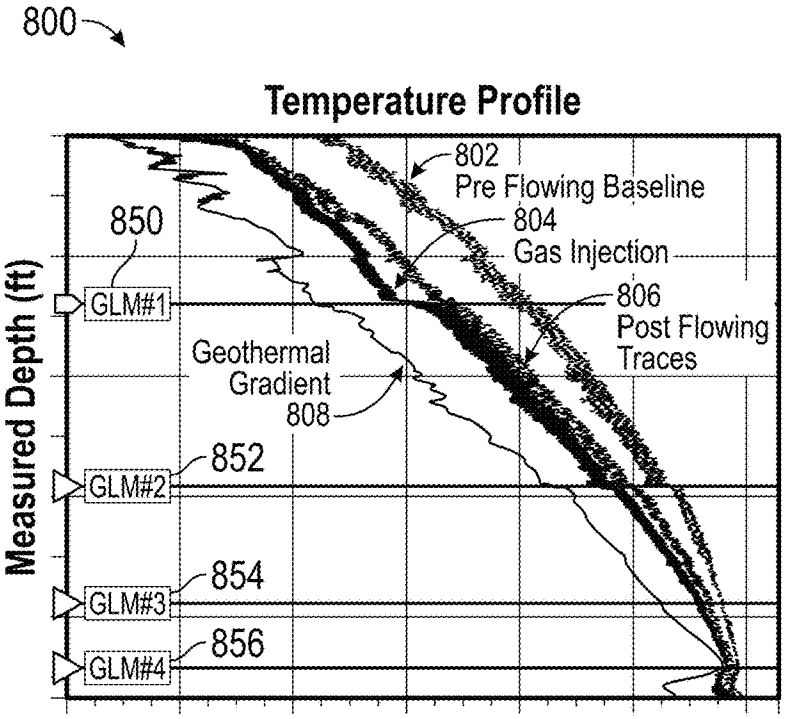
FIGS. 8A and 8B illustrate example temperature measurements during unloading of a gas lift valve, in accordance with aspects of the present disclosure.
Figure 8B:
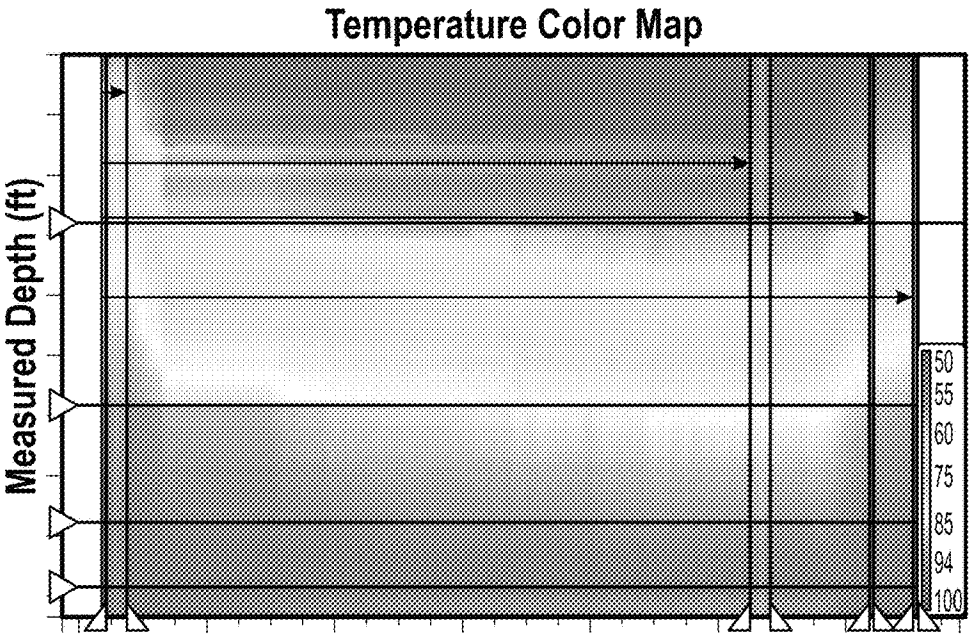

FIGS. 8A and 8B illustrate example temperature measurements during unloading of a gas lift valve 606. The temperature profile in FIG. 8A and the temperature color map in FIG. 8B are aligned by showing the lines where gas lift valves 850, 852, 854, 856 are located in respect to measured depth. As shown in FIGS. 8A and 8B, the gas injection measurements 804, post flowing traces 806, and/or geothermal gradient 808 can deviate from the pre flowing baseline 802. The temperature measurements, for example obtained by fiber optic cable 620, can indicate whether the gas lift valve 606 is operating as expected. When a fiber optic cable 620 is utilized, it can be easily determined exactly which gas lift valve 606 is operating as expected—or not operating as expected—based on the determined depth.

In at least one example, operators may also use fiber optic cable 620 to measure and monitor acoustic and/or thermal signatures of all gas lift valves 606 to determine if there are leaks and/or malfunctioning gas lift valve(s) 606. The identified faulty gas lift valve(s) 606 can then swiftly be fixed and/or replaced, for example using wireline operations, whereas the conventional procedure is to replace gas lift valves one at the time until a problem has been mitigated. This conventional process of replacing gas lift valves one at the time is time consuming with associated expense. Thermal and/or acoustic signals deviating from a base line in a steady state environment could indicate leaks or flowing wells. Downhole pressure may also be used as a flow indicator. Baseline can, for example, be a flowing wellbore, shut-in wellbore, and/or geothermal and/or step changes/deviations from trends.

Figure 9:
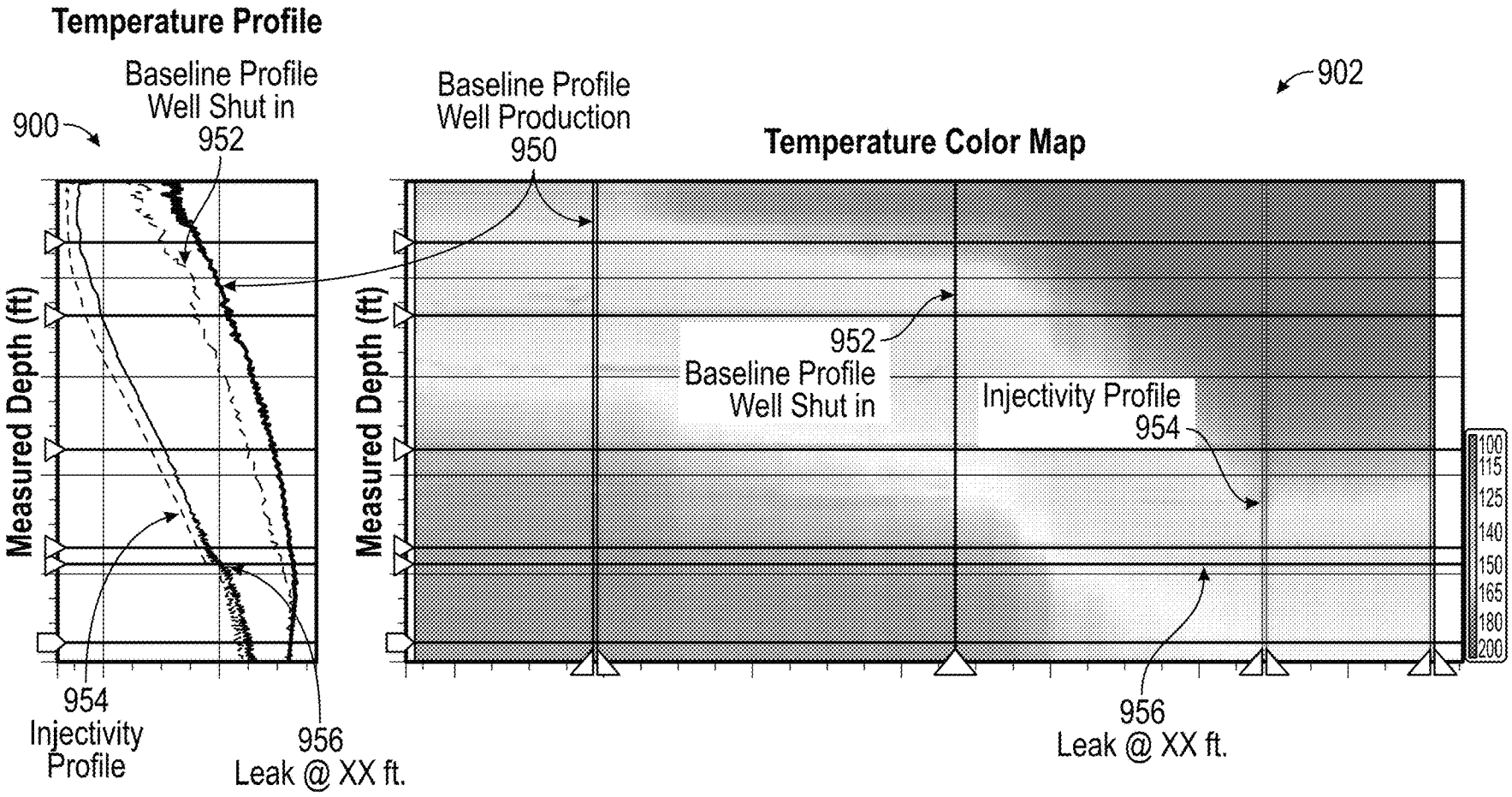
FIG. 9 illustrates example temperature measurements showing a malfunctioning gas lift valve, in accordance with aspects of the present disclosure.

FIG. 9 illustrates an example temperature profile 900 and temperature color map 902 of a malfunctioning gas lift valve 606. A deviation from the baseline profile well production 950 and the baseline profile well shut in 952 in relation to the injectivity profile 954 is shown at the depth where the gas lift valve 606 is installed as part of the tubing 602, indicating a malfunction 956, such as a leak.

Figure 10:
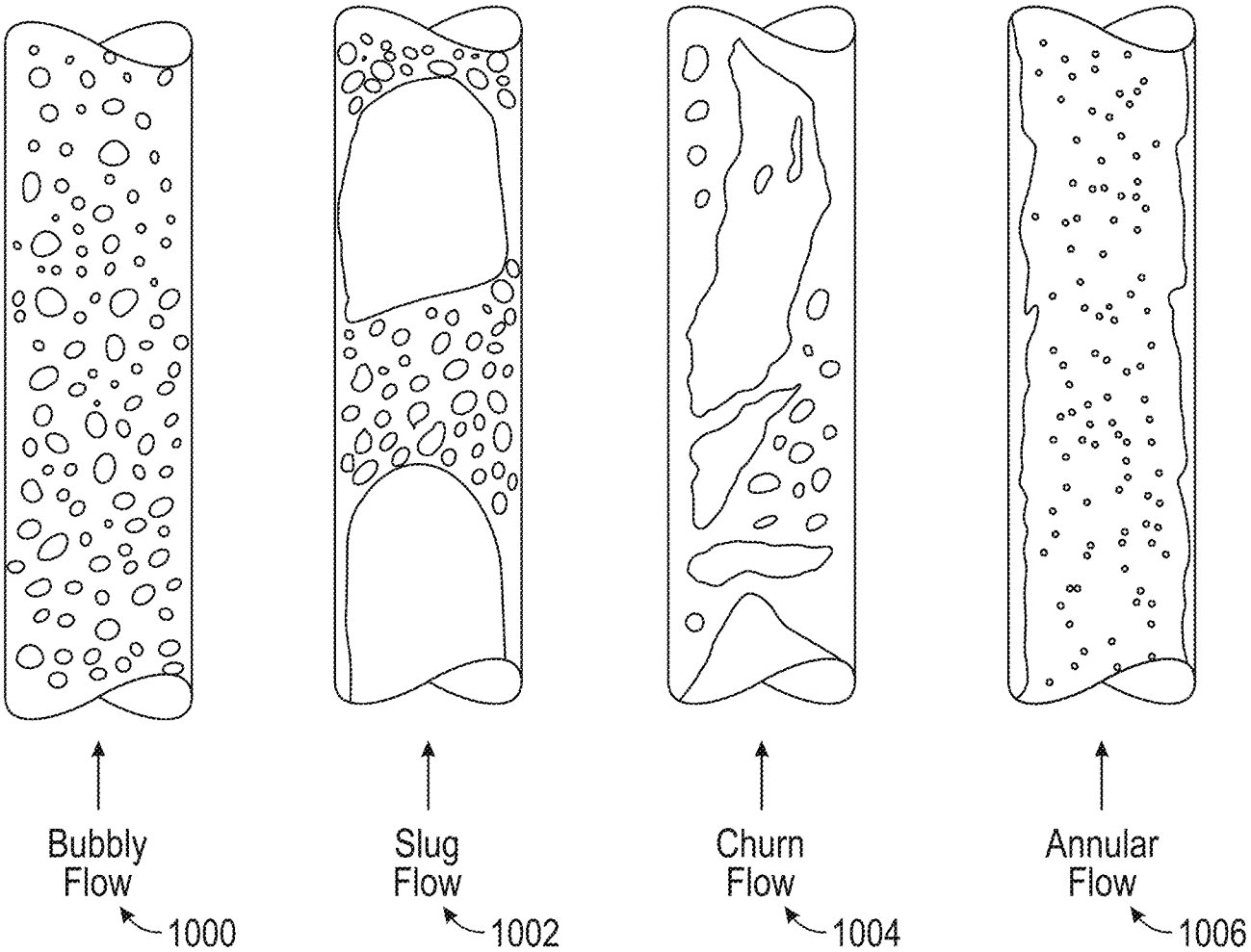
FIG. 10 illustrates example flow patterns in a two-phase vertical (e.g., upward) flow, in accordance with aspects of the present disclosure.

FIG. 10 illustrates example flow patterns in a two-phase vertical (e.g., upward) flow, in accordance with aspects of the present disclosure. The flow patterns in the two-phase vertical flow can include a bubbly flow 1000, a slug flow 1002, a churn flow 1004, and an annular flow 1006.

Figure 11:
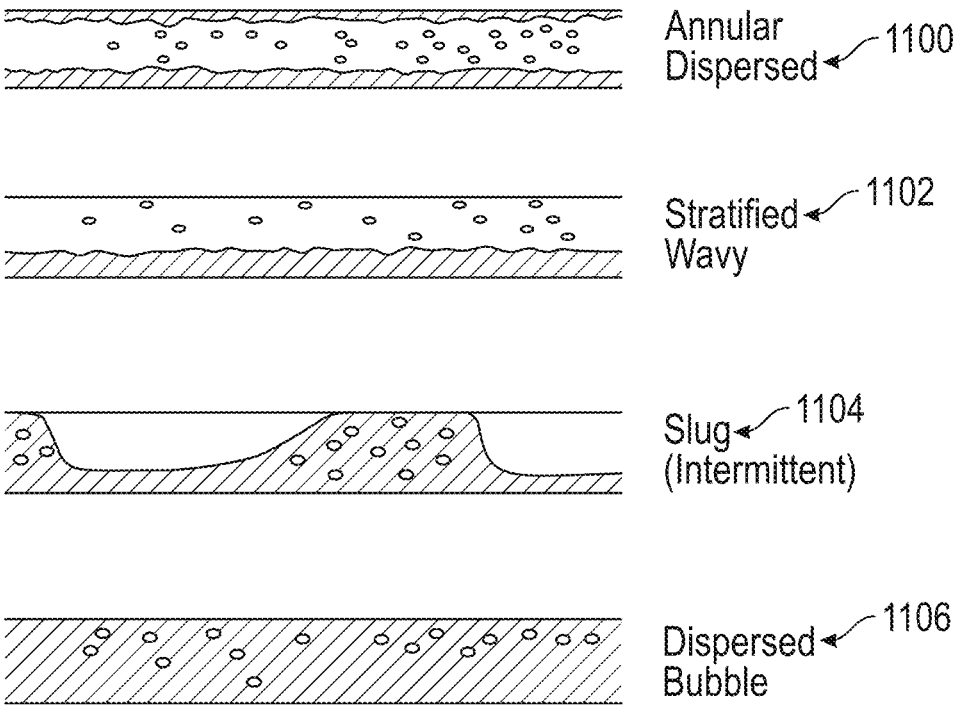
FIG. 11 illustrates example flow patterns in a horizontal two-phase flow, in accordance with aspects of the present disclosure.

FIG. 11 illustrates example flow patterns in a horizontal two-phase flow, in accordance with aspects of the present disclosure. The flow patterns in the horizontal two-phase flow can include annular dispersed 1100, stratified wavy 1102, slug (e.g., intermittent) 1104, and dispersed bubble 1006.

In some examples, the flow regime can change: along the wellbore; over time, as production rates decrease due to natural depletion; over time, as production mix changes due to natural depletion; and over time, as pressure changes due to natural depletion (e.g., solution gas).

Figure 12:
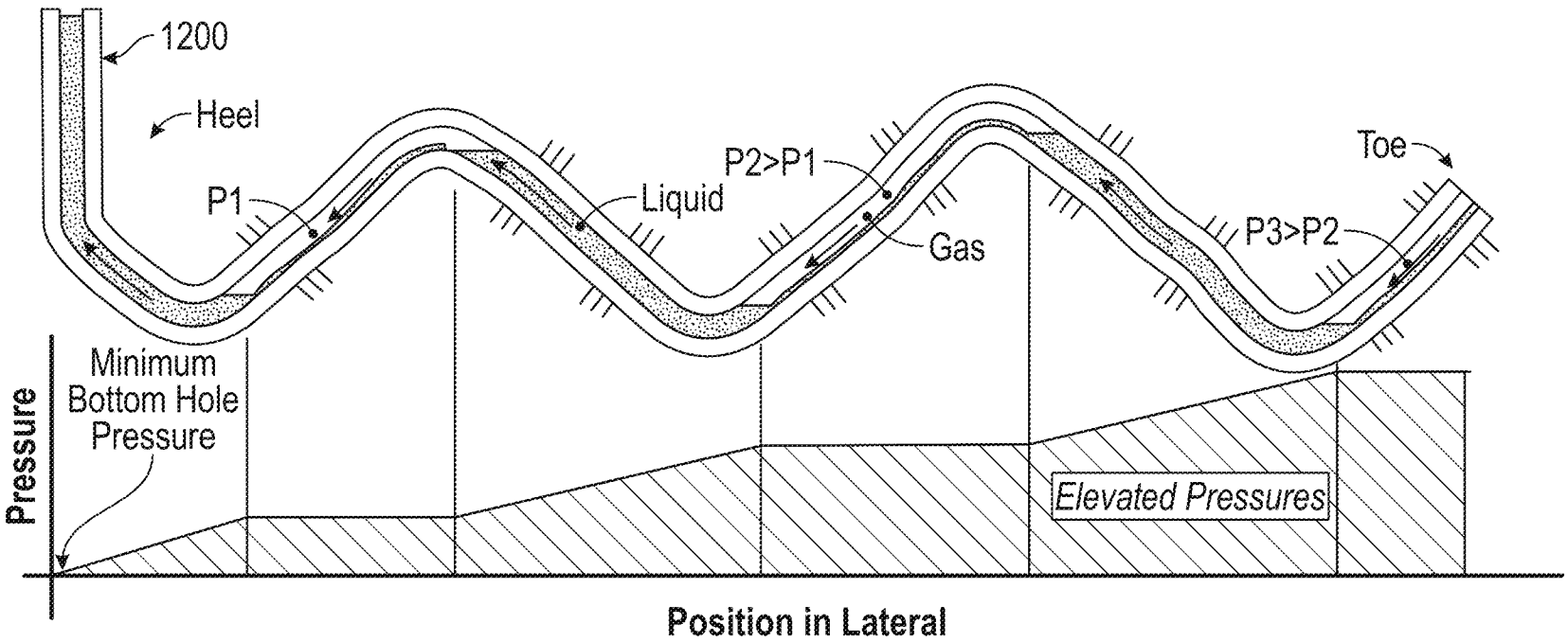
FIG. 12 illustrates an example of an undulating well, in accordance with aspects of the present disclosure.

FIG. 12 illustrates an example of an undulating well 1200, in accordance with aspects of the present disclosure. Drilling is rarely performed in a perfectly straight line, there are natural undulations that occur during the drilling process. Directional drilling is also used to target predetermined areas in reservoir layers and sometimes even in different reservoir layers within the same well. As such, it can be difficult to replicate in-situ conditions. Flow loop test facilities are sometimes built in urban areas with traffic and environmental noise. Pumps, flow lines, and injection points can generate noise that varies with flow rate, phase composition, density, viscosity, etc.

Figure 13:
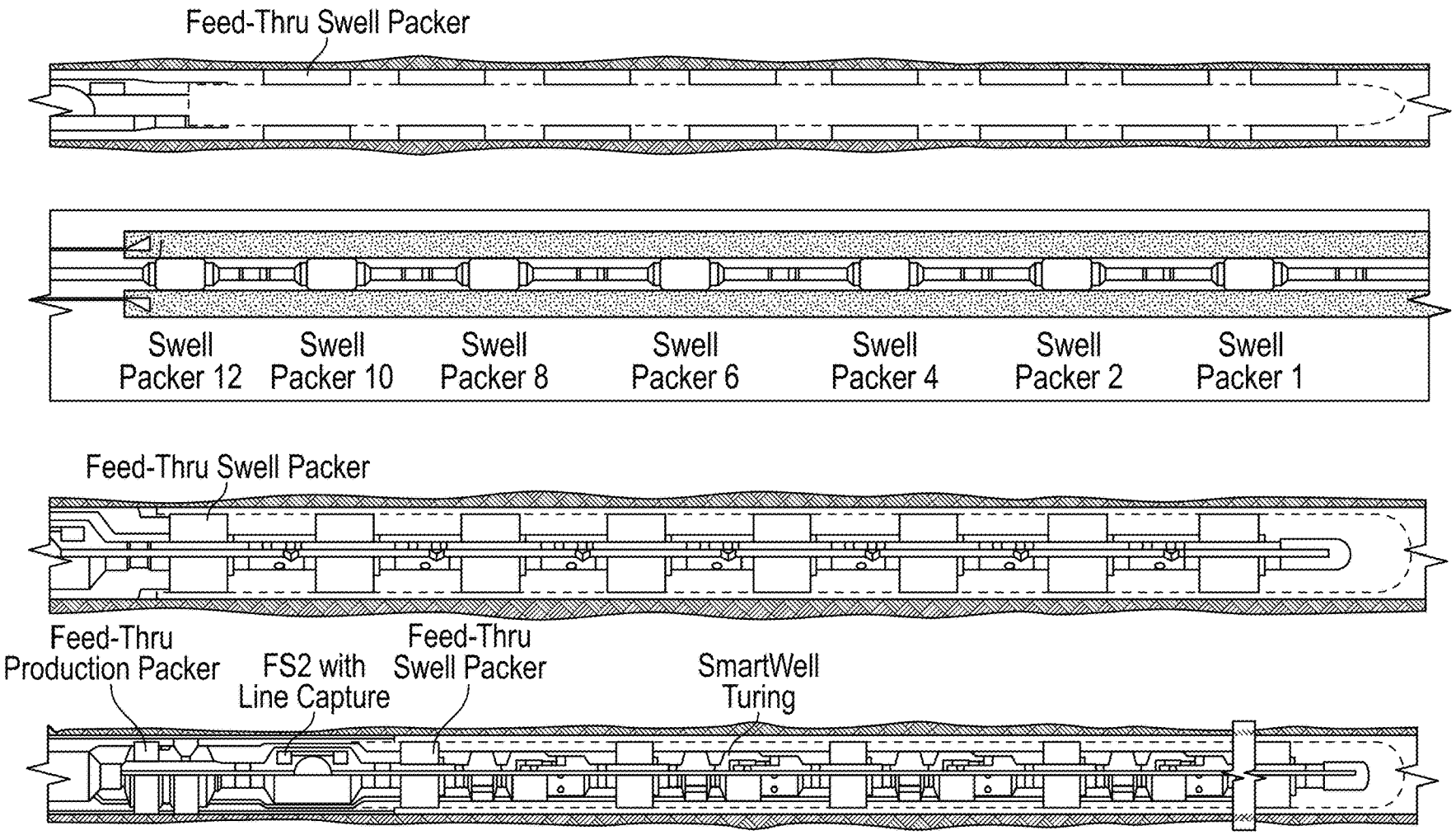
FIG. 13 illustrates a cross-sectional view of example wells including hardware, in accordance with aspects of the present disclosure.
Figure 14:
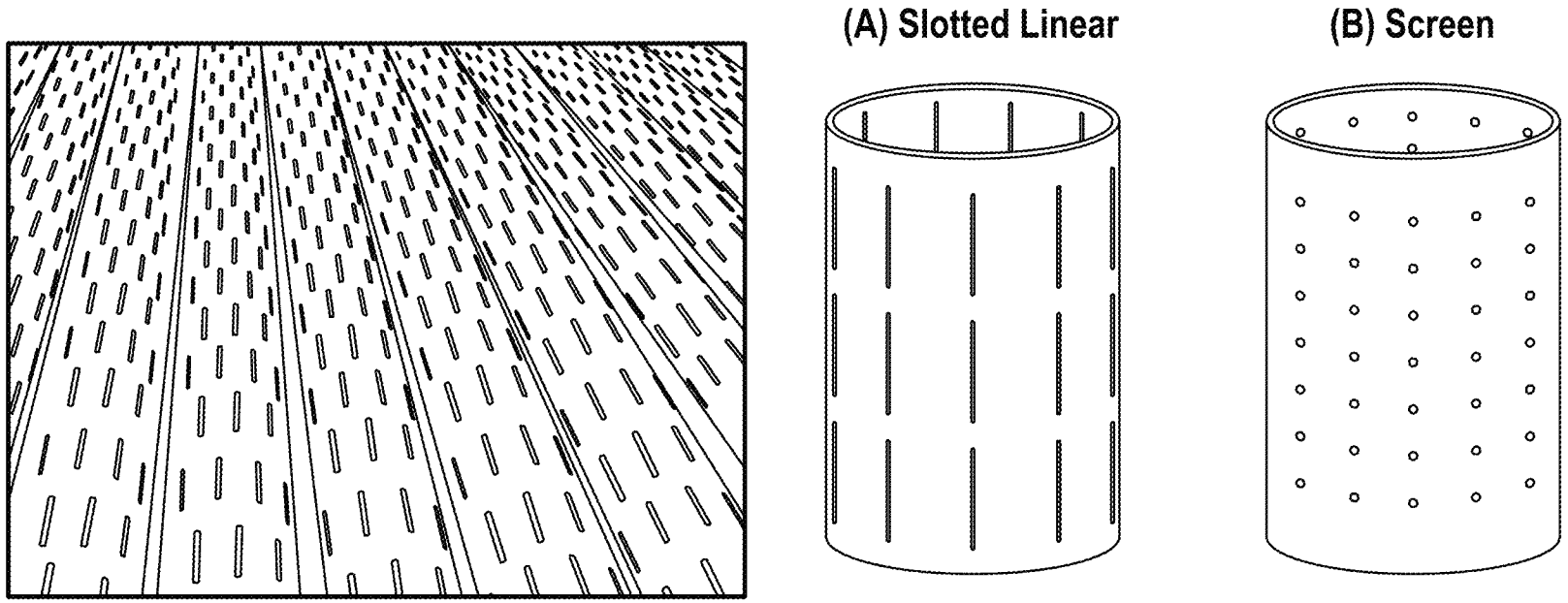
FIG. 14 illustrates example well liners, in accordance with aspects of the present disclosure.

FIG. 13 illustrates a cross-sectional view of example wells including hardware, in accordance with aspects of the present disclosure. FIG. 14 illustrates example well liners, in accordance with aspects of the present disclosure. Wells can be completed by utilizing different hardware such as swell packers, hydraulic set packers, Inflow Control Devices (ICDs), Inflow Control Valves (ICVs), perforated liners/screens/slotted lines/limited entry liners, etc. Different designs may also impact flow properties and measured data. Electrical, optical, and/or hydraulic lines may be deployed with different hardware including the well examples in FIG. 13.

While a limited flow loop test setup can be used to simulate a specific well to build production flow models, actual conditions may render the production flow model inaccurate and become obsolete over the life of the well. As such, there is a need for an improved process for developing production flow models where the production flow model can be built in-situ and also be updated on demand.

Figure 15:
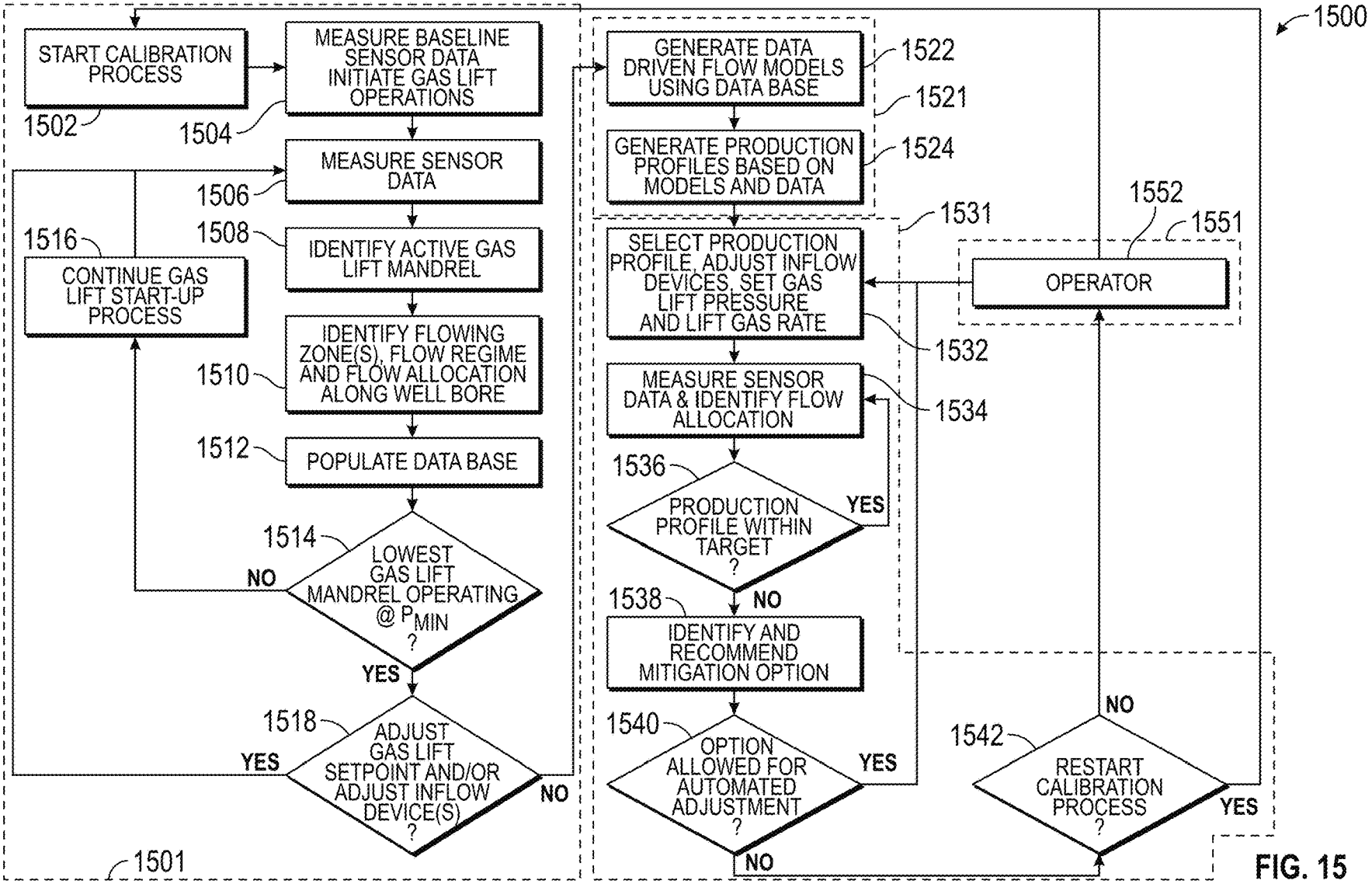
FIG. 15 illustrates an example flow chart for generating data driven models, in accordance with aspects of the present disclosure.

FIG. 15 illustrates an example flow chart of a process for generating data driven models 1500, in accordance with aspects of the present disclosure.

At step 1502, the process 1500 can include starting a calibration process.

At step 1504, the process 1500 can include measuring baseline sensor data and initiating gas lift operations.

At step 1506, the process 1500 can include measuring sensor data.

At step 1508, the process 1500 can include identifying active gas lift valves.

At step 1510, the process 1500 can include identifying flowing zone(s), flow regimes, and flow allocation along a wellbore. Step 1510 of the process 1500 can also include using raw and/or processed sensor data, physical models, data driven models, previously identified signatures of events or conditions, correlations with surface measurements, or flow models generated through flow loop experiments.

At step 1512, the process 1500 can include populating a database.

At step 1514, the process 1500 can include determining whether the lowest (e.g., furthest downhole) gas lift valve is operating to produce at a target rate. If not, the process 1500 can proceed to step 1516 for continuing the gas lift start-up process. If yes, the process 1500 can proceed to step 1518.

At step 1518, the process 1500 can include determining whether to adjust the gas lift setpoint and/or adjust inflow device(s). If yes, the process 1500 can proceed to step 1506 for measuring sensor data and continuing the data measuring process. If no, the process 1500 can proceed to step 1522.

At step 1522, the process 1500 can include generating data driven flow models using the database.

At step 1524, the process 1500 can include generating production profiles based on models and data.

At step 1532, the process 1500 can include selecting a production profile, adjusting inflow devices, setting gas lift pressure, and/or set lift gas rate.

At step 1534, the process 1500 can include measuring sensor data and identifying flow allocation.

At step 1536, the process 1500 can include determining whether the production profile is within a target range. If yes, the process 1500 can proceed to step 1526 for measuring sensor data and identifying flow allocation. If no, the process 1500 can proceed to step 1538 for identifying and recommending mitigation options, such as changing settings, water injection, and/or gas lift production.

At step 1540, the process 1500 can include determining whether an option is allowed for automated adjustment, for example without user input or assistance. If yes, the process 1500 can proceed to step 1532 for selecting production profiles, adjusting inflow devices, set gas lift pressure, and/or set lift gas rate. If no, the process 1500 can proceed to step 1542 for restarting the calibration process.

At step 1542, the process 1500 can include determining whether to restart the calibration process. If yes, the process 1500 can proceed to step 1502 and restart the calibration process. If no, the process 1500 can proceed to the step 1552 for awaiting operator action.

In some implementations, the process 1500 can be a data driven approach to flow monitoring model in completions with zonal inflow control, where the completion can be equipped with distributed fiber optic sensing and pressure sensors. The process 1500 can be utilized for injection or production monitoring.

There are numerous challenges with building injection and production flow models.

No two reservoirs or wells in a reservoir/formation are identical. Porosity, permeability, pore throat sizes, chemical composition, layers, faults, depths, temperatures, pressures, etc. all depend on how the reservoir was formed over time, which also varies based on location. Moreover, reservoirs deplete over time. As such, pressure, flow rates, and gas-oil-water ratios also change. Solution gas, gas oil interfaces, and oil water interfaces also move. Flow regimes can also change as the fluid composition changes over time and/or the distance changes along the wellbore. Flow regime can further change along the wellbore as the flow rate can be different between the toe of the well and the heel of the well.

In some implementations, the process 1500 can include utilizing a surface multi-phase flow metering system or similar systems for determining flow rates of oil, water, and/or gas (e.g., step 1504 and/or 1506 of FIG. 15). The process 1500 can further include utilizing a surface sensing system capable of sensing pressure, resistance, capacitance, etc. (e.g., step 1506 of FIG. 15). Moreover, the process 1500 can include utilizing a subsurface sensing system such as a distributed fiber optic cable. The distributed fiber optic cable can be a DAS, DTS, strain, pressure sensor, etc., and can be associated with surface interrogation units.

In some implementations, the process 1500 can be capable of model flow rate (surface and/or subsurface using a distributed fiber optic cable) and/or downhole pressure as a function of gas lift pressure and injected lift gas volume, and/or create transfer functions based on a sweep of gas lift pressure and/or injected lift gas volume vs. downhole pressure and/or flow rate.

The closed loop control process 1500 can control input variables (for example gas lift pressure and/or lift gas rate/volume), measure various sensed properties (e.g., step 1506), for example utilizing a distributed fiber optic cable, to determine flow rates/zones using models, determine transfer functions for various output variables (surface flow rate, flow rate/phase per zone) as a function of input variables, and/or control or optimize the selected properties/set points.

The process 1500 can set gas lift injection pressure and lift gas volume to target selected flow rate and/or downhole pressure. The process 1500 can measure and provide closed loop control to achieve selected flow rates and/or downhole pressure for a single selected point where the point measurement for control may be selected at a specific location. In some examples, a model may be used to select a set point based on flow rate/phase contribution across multiple production zones/intervals. Higher drawdown may, for example, create gas and/or water fingering, which may be detected using the distributed fiber optic cable system, and the models may then flag this as a condition that needs to be mitigated by, for example, changing the gas lift pressure set point and/or reducing the lift gas rate/volume for wells with distributed slotted liners or perforated lines or limited entry liners (e.g., FIG. 14). Wellbores may include completions with Inflow Control Valves (ICVs) or Inflow Control Devices (ICDs) where the inflow area for one of these devices may be adjusted using surface controlled hydraulics or wireline operations to mitigate undesirable flow rates from the specific zone identified by the distributed fiber optic cable system.

Flow rate and/or phase contribution may be measured and/or calculated using data, for example from one or more sensing system ranging from a distributed acoustic sensor measurement only to models with input from other sensing systems or calculated data such as modeled and/or measured differential pressure across a zone (e.g. ICV, liners etc.) and measured distributed fiber optic data (e.g. DAS and/or DTS). DAS data may be used for flow regime identification and then flow rate identification based on frequency and/or amplitude dependent acoustic signatures across one or more frequency ranges where flow regime identification and flow rate identification may be done using data driven models.

In some examples, it may also be beneficial to tie individual well controls to reservoir level objectives. A supervisory system may correlate water injector rate from neighboring injector wells per reservoir layer with measured phase contribution per zone, and control water injection rates on individual injector wells. Means of determining which wells to control and what the connectivity is may use methods like correlating pressure communication between injector well and producer well by measuring pressure response in production well when injector well rate is changed using a predetermined pressure change (controlled rate step change, uncontrolled rate change so measure and flag by deviation from base line). Other means of determining connectivity and rates may include tracer technology.

Reservoir level production and depletion rates may also result in reservoir subsidence, which may be mitigated, for example by using water injection. InSAR and tilt meter measurements may be used to determine well level and/or reservoir level subsidence and this may influence injection and/or production rates for both individual wells and/or reservoir areas to avoid excessive subsidence. Offshore and subsea reservoirs may be monitored using tilt meters deployed using gravity based torpedo like structures that are dropped from a vessel and drop to the seafloor where they burrow into the ocean floor by the momentum they gain as they travel through the water column from the surface to the ocean floor.

DAS systems may be used for Vertical Seismic Profiling (VSP) surveys and/or reflection seismic surveys to monitor fluid front movement and water flood efficiency. The data may also be used to identify pockets of bypassed hydrocarbons that may be produced by changing injection/production rates of wells, or the data may be used to identify areas for infill drilling of additional injectors or producer wells.

The process 1500 includes the added benefit collecting data in the real environment where the sensing system is to be used. The environmental noise is also very low, while reservoir characteristics driving production rates are realistic. The hardware and flow orifices are also the actual devises used for the life of the well. The flow model can further be customized for a specific application. Furthermore, the flow model can be continuously updated based on measured data.

The steps of the process 1500 included in region 1501 can include generating data for the data driven models at step 1522. The steps of the process 1500 included in the region 1501 can generate a number of possible production scenarios that can be duplicated by changing the total flow rate at the surface or by changing down-hole flow control devices while collecting data. The steps of the process 1500 included in the region 1501 can further include randomizing the data (e.g., set points) such that that systematic errors may be minimized. For example, surface chokes and/or inflow control devices may have systematic errors when operated in one direction. As such, the process 1500 can include reducing these types of errors by systematically increasing or decreasing the settings versus only increasing the settings until all data points have been taken and then decreasing the settings until the device is closed.

The steps of the process 1500 included in region 1521 can include generating the data driven flow models. For example, the data received and determined in the steps of region 1501 can be utilized to generate relationships such as the data driven flow models at step 1522. The data driven flow models can be generated based on design parameters, inflow conditions, surface and subsurface measurements, and production output using machine learning (ML)/artificial intelligence (AI) algorithms. The process 1500 can further include utilizing supervised and unsupervised ML/AI algorithms to generate the data driven flow models.

Given the amount of data collected through utilizing the DAS/DTS fiber optic lines, surface and subsurface sensors may be significant. As such, unsupervised learning such as Principal Component Analysis (PCA) and Independent Component Analysis (ICA) can be used by the process 1500 to reduce dimensions to components, while explaining a high percentage of variance in the data. Furthermore, the process 1500 can include utilizing a clustering technique such as DBSCAN, Gaussian Mixture, K-means, etc., that can be used to cluster possible conditions to a subset of clusters with a homogenous behavior. The data in each cluster can then will be used by the process 1500 to develop a flow model specific for that particular cluster. Moreover, examining the distance between the clusters and the variables driving this distance can be used by the process 1500 as a control measure to move from a cluster with an undesired production profile to clusters with a higher/desirable production profile.

The process 1500 can further include utilizing autoencoder deep learning models (e.g., Long Short Term Memory (LSTM), Recurrent Neural Network (RNN), and Deep Neural Network (DNN) autoencoders) to reduce dimensionality. Furthermore, the autoencoder deep learning models can be used to detect anomalies during monitoring of the well.

In the supervised learning model, some parameters of production output (e.g., either univariate with a single output parameter or multivariate with multiple outputs such as oil, gas, and water production) can be used as a target while the design parameters, surface measurements, and subsurface measurements can be utilized as predictors. The supervised learning model can be established by employing time-series ML/AI algorithms such as RNN and LSTM. The supervised learning model can further be established on different aggregated levels using non-time-series ML/AI algorithms such as DNN, Randomforest, gradient boosting, etc. Furthermore, the data measured by the process 1500 can be utilized to generate the flow models to predict both surface output and contribution of each production intervals.

In some implementations, the supervised and unsupervised models can also be used as a generator of production profiles under different conditions, as shown in step 1524 of FIG. 15. Furthermore, the supervised and unsupervised models can be used to estimate optimum conditions or desired outcomes by utilizing reverse optimization.

In other implementations, the steps of region 1521 can include utilizing reinforcement deep learning algorithms that can develop a control mechanism to optimized requirement specifications set by a customer or an operator 1552. In one example, the process 1500 can include utilizing a developed model as described herein that can provide a predetermined output (e.g., as a goal of a game) and a reinforcement learning algorithm to generate an input to the model, thereby learning how to achieve the highest award by reaching to the predetermined output. In another example, the process 1500 can include a flow loop (e.g., being game rules) and allow the algorithm to control the flow loop to achieve a set goal. In this example, the gathering of data and optimization can be performed simultaneously by the algorithm.

The steps of the process 1500 included in region 1531 can include providing real-time production automation. For example, at step 1540, a production target may include boundaries (e.g., an upper boundary and a lower boundary) where actual production may be allowed to vary in between. If average values deviate beyond these boundaries (e.g., increased water production from a zone), the production flow monitoring system can automatically reduce the flow contribution from the corresponding zone. The process 1500 can include utilizing various data driven approaches to predict production variation and change system settings in response to the corresponding predictions.

Figure 18:
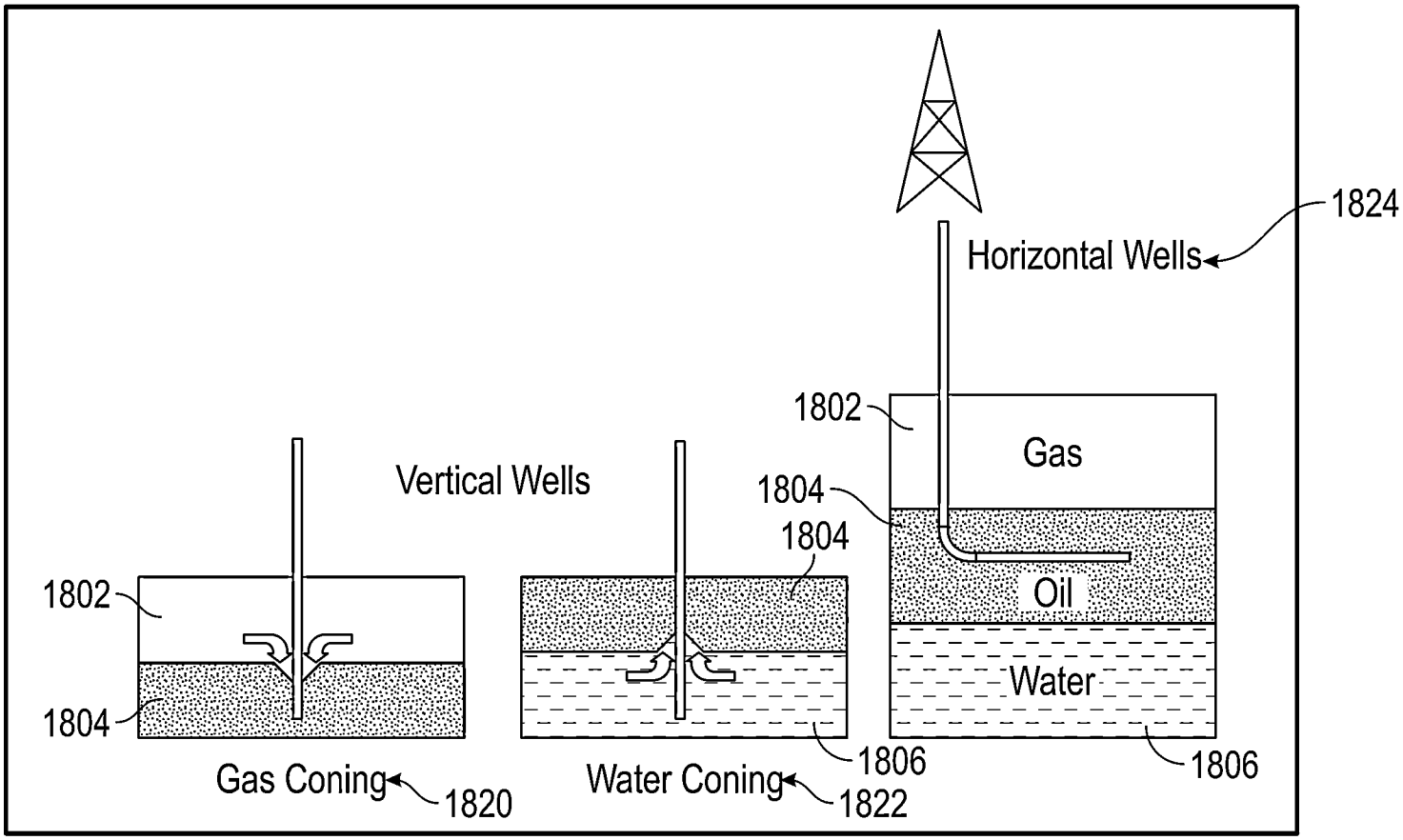
FIG. 18 illustrates examples of gas and water coning in vertical wellbores in comparison to horizontal wellbores.

The distributed fiber optic sensor data and system may be used to identify water and/or gas coning (see FIG. 18) and adjust production rates and/or inflow control device settings. As shown in FIG. 18, gas coning 1820 can occur between gas 1802 and oil 1804. Water coning 1822 can occur between oil 1804 and water 1806. Horizontal wells 1824 can increase the exposure of the pay-zone and/or allow a higher production rate at lower drawdown pressure resulting in less coning.

Other events that can be identified may include leak detection, out of zone injection and/or production, and/or non-responsive inflow control devices. The signature of these events may be imported and added to/used in the automated step where data driven flow models and data driven production profiles are compared to target—Decision diamond "Production profile within target".

The steps of the process 1500 included in region 1551 can include providing exception handling and set point selection. For example, the operator 1552 may be an individual or a data driven input from a supervisory level system, where inputs from multiple wells in a field can be used to compute well and zone specific set points. In some examples, a zone or a number of zones may be tied to a specific reservoir layer in a particular field. Some wells may also be injecting water into the reservoir layer through injection wells, while other wells in the field may be producing hydrocarbons in the same field. The supervisory level system of the production flow monitoring system can monitor sweep efficiencies of the reservoir layers using 3D/4D seismic data. The seismic data may be collected by the DAS-based fiber optic systems and/or other seismic sensors. The supervisory system can also monitor reservoir level pressure with the intent of maintaining pressure at set levels to manage solution gas, gas, oil, and oil/water interfaces, and to manage naturally flowing wells. The measured data can be pressure in one or multiple wells, and the control lever can adjust water injection rates and pressures in one or multiple wells.

At step 1532, the process 1500 can further include being operated manually or automatically based on conditions. For example, depending on the scope of automation and what is exception-based, the step 1532 of process 1500 can include manual actions by the operator 1552 or automatic supervisory level expert system input.

Figure 16:
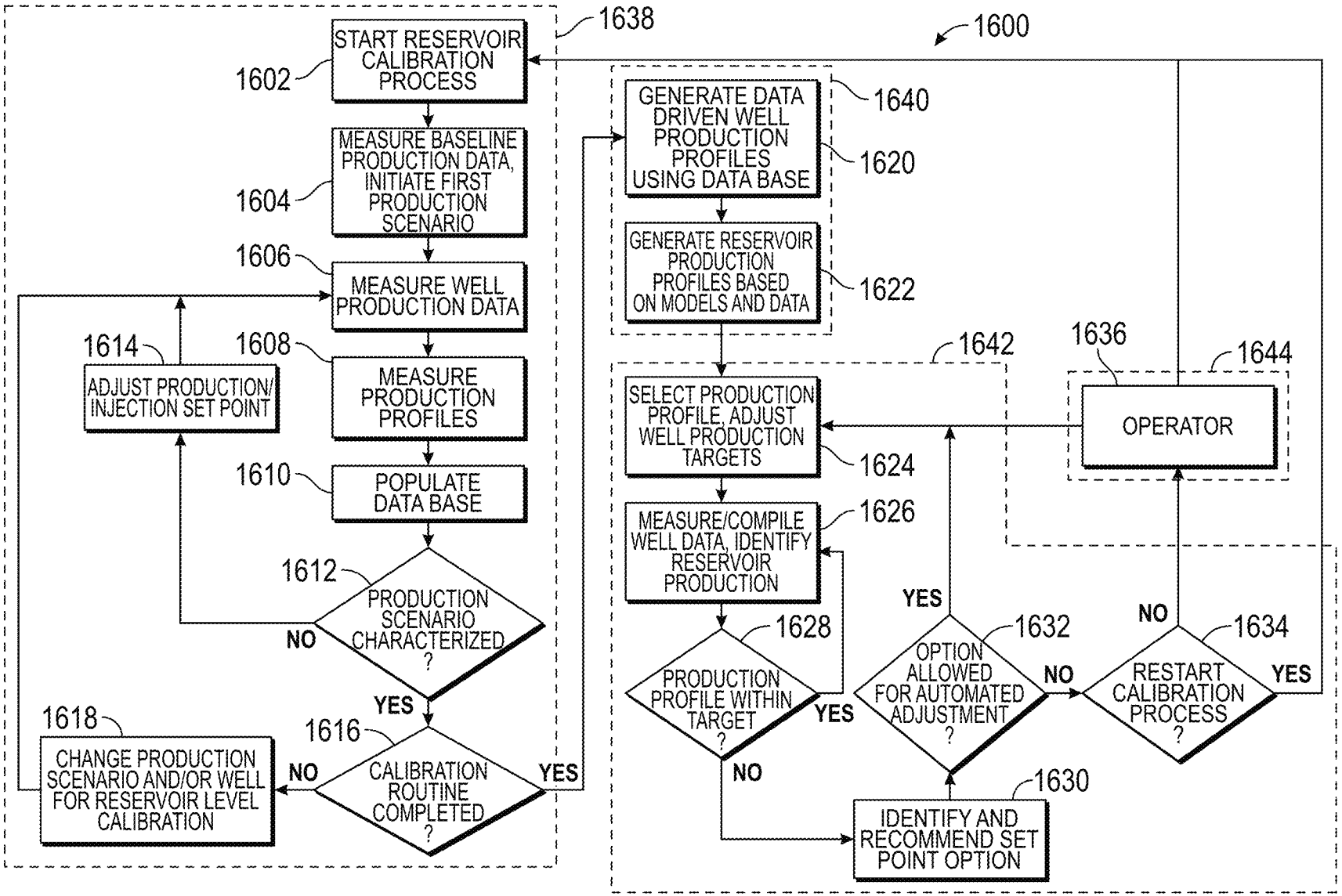
FIG. 16 illustrates an example flow chart of a process for utilizing a supervisory system, in accordance with aspects of the present disclosure.

FIG. 16 illustrates an example flow chart of a process for utilizing a supervisory system 1600, in accordance with aspects of the present disclosure. In some implementations, the supervisory process 1600 can be utilized at step 1552 of the process 1500 as shown in FIG. 15 for a single well or multiple wells. In other implementations, the supervisory process 1600 can be performed in conjunction with the process 1500, where communication between the supervisory system and the production flow monitoring system can be facilitated by code/communication software at step 1552 of the process 1500. The supervisory process 1600 for a reservoir level can be similar to the process 1500. However, a calibration process can apply to multiple wells in a reservoir instead of zones in a well. Regions 1640 and 1642, for the supervisory level, can apply to reservoir production models and reservoir production automation.

Referring to FIG. 16, the supervisory system of the supervisory process 1600 can generate a reservoir level model using similar approaches (e.g., as described in the production flow monitoring system of FIG. 15) for a well level. The reservoir supervisory system can control injection and production targets for wells, as well as for reservoir water flood sweep efficiency. Additional data such as reservoir, well specific Vertical Seismic Profiles (VSP), and seismic profiles can be received/measured using DAS systems/fibers that may be installed in the individual wells in order to monitor the progression of water flood efficiency.

At step 1602, the supervisory process 1600 can include starting a reservoir calibration process.

At step 1604, the supervisory process 1600 can include measuring baseline production data and initiating a first production scenario. While the disclosure may discuss the supervisory process 1600 in relation to production, the supervisory process 1600 can be implemented for different processes, for example production and/or injection. Accordingly, injection data and/or injection scenarios may be included.

At step 1606, the supervisory process 1600 can include measuring well production and/or injection data.

At step 1608, the supervisory process 1600 can include measuring production and/or injection profiles.

At step 1610, the supervisory process 1600 can include populating a database.

At step 1612, the supervisory process 1600 can include determining a production scenario that is characterized. If not, the supervisory process 1600 can proceed to step 1614 for adjusting production and/or injection set points. If yes, the supervisory process 1600 can proceed to step 1616.

At step 1616, the supervisory process 1600 can include determining whether a calibration routine is complete. If not, the supervisory process 1600 can proceed to step 1618 for changing production scenarios and/or well for reservoir level calibration. If yes, the supervisory process 1600 can proceed to step 1620.

At step 1620, the supervisory process 1600 can include generating data driven well production and/or injection profiles using the database.

At step 1622, the supervisory process 1600 can include generating reservoir production and/or injection profiles based on the models and data.

At step 1624, the supervisory process 1600 can include selecting a reservoir production profile and adjusting well injection and/or production targets (e.g., devices as described herein).

At step 1626, the supervisory process 1600 can include measuring or compiling well data and identifying reservoir production and/or injection.

At step 1628, the supervisory process 1600 can include determining whether the reservoir production and/or injection profile is within a target range. If not, the supervisory process 1600 can proceed to step 1630 for identifying and recommending individual well injection and/or production set point options. If yes, the supervisory process 1600 can proceed to step 1626 for measuring or compiling well data and identifying reservoir production and/or injection.

At step 1632, the supervisory process 1600 can include determining whether an option is allowed for automated adjustment. If not, the supervisory process 1600 can proceed to step 1634 for restarting the calibration process. If yes, the supervisory process 1600 can proceed to step 1624 for selecting a production and/or injection profile and adjusting well injection and/or production targets (e.g., devices as described herein).

At step 1634, the supervisory process 1600 can include determining whether to restart the calibration process. If not, the supervisory process 1600 can proceed to the step 1636 for awaiting operator action. If yes, the supervisory process 1600 can proceed to step 1602 and restart the reservoir calibration process.

Regions 1638, 1640, 1642 of the supervisory process 1600 can be similar to regions 1501, 1521, 1531 of the process 1500, respectively.

Figure 17:
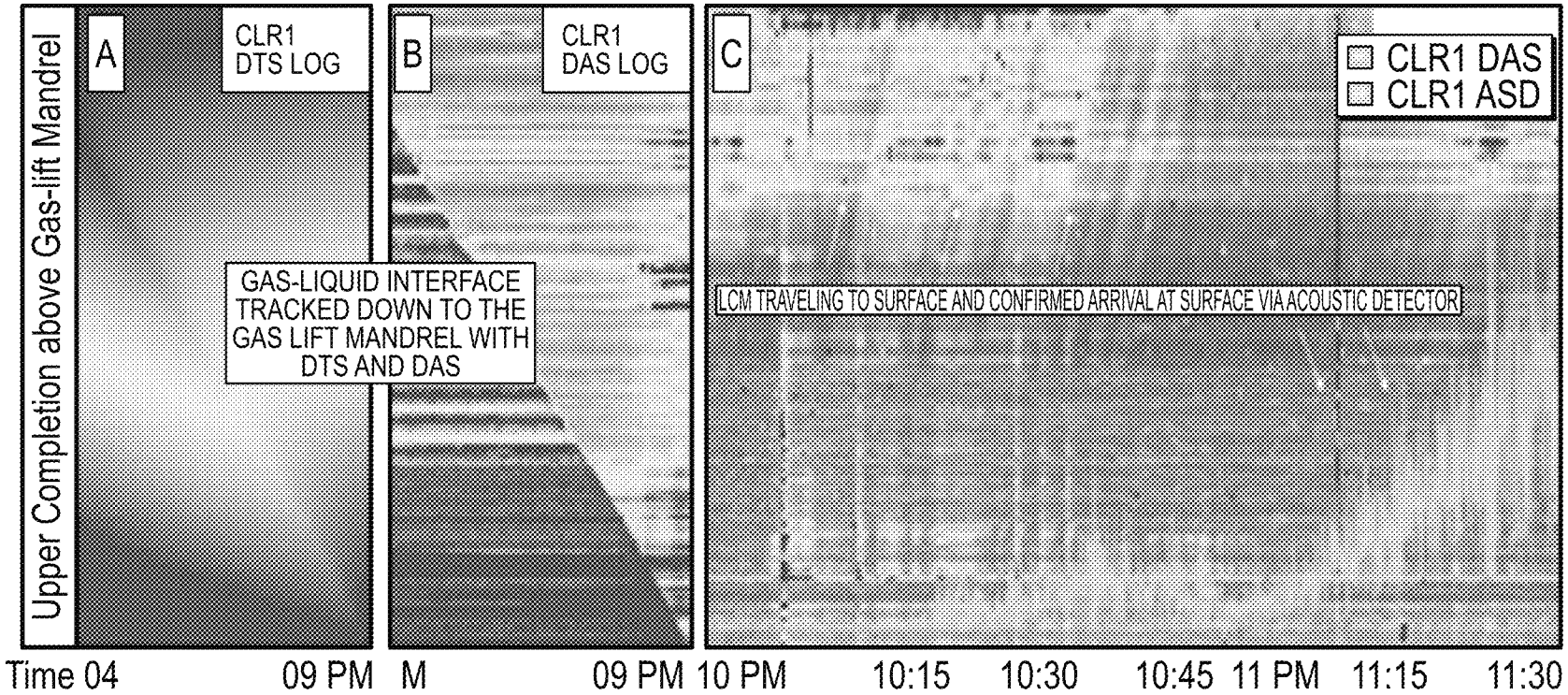
FIG. 17 illustrates an example of early life performance monitoring with distributed fiber optic cable sensor.

FIG. 17 illustrates an example of early life performance monitoring with distributed fiber optic cable sensor, for example DTS (A) and DAS (B). Waterfall charts can be used to track the gas-liquid interface from the surface down to the gas lift valves. DAS solid transport logs (C) can be used in detecting solid infused slugs which can be confirmed, for example, by a surface acoustic sand detector. DTS and/or DAS data can be used to predict when specific gas lift valves may activate based on the measured gas-liquid interface data and the rate of change. This data can then be used to predict and control reservoir level production targets as well as plan for lift gas usage across an asset.

Figure 19:
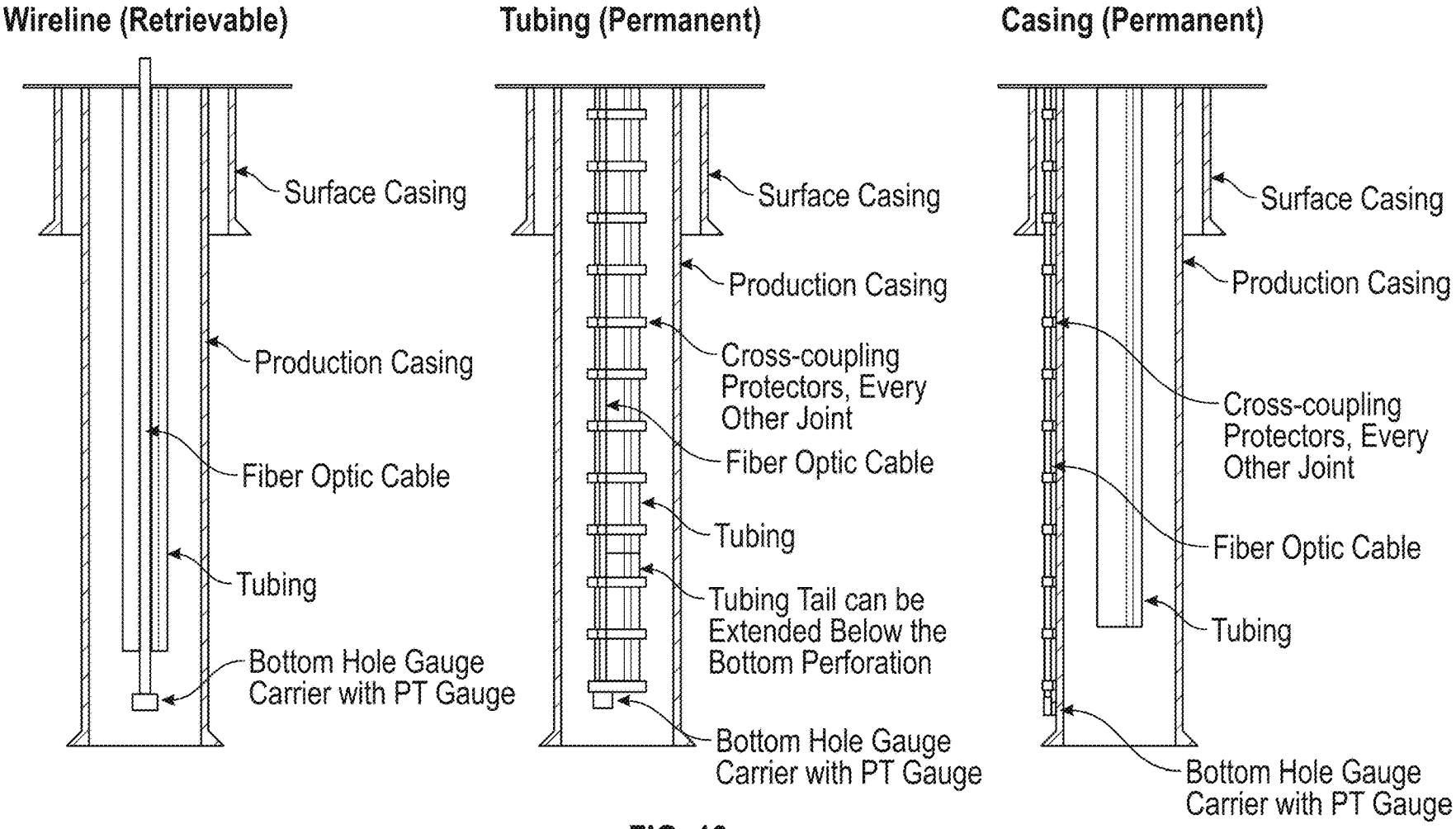
FIG. 19 illustrates example fiber optic sensing arrangements, in accordance with aspects of the present disclosure.

FIG. 19 illustrates example fiber optic sensing arrangements, in accordance with aspects of the present disclosure. For example, fiber optic sensing can be used for various sensing applications in the oil and gas industry. The production flow monitoring system as described herein can utilize Distributed Fiber Optic (DFOS) sensing systems and single/multipoint sensors.

Referring to FIG. 19, three types of fiber optic sensing arrangements are shown: 1) wireline (retrievable), tubing (permanent), and casing (permanent).

Permanently installed sensors may include fiber optic cables cemented in place in the annular space between the casing and the formation. The fiber optic cables may be clamped to the outside of the casing during deployment and protected by centralizers and cross coupling clamps during Run-In-Hole (RIH). Some examples include utilizing tubing conveyed cables, retrievable sensing cables such as wireline and slickline, or cables that are deployed inside a coiled tubing. Fiber optic cables can also be deployed in wells using gravity where a weight or conveyance vehicle can be dropped into a wellbore, where the fiber is then released into the well as the deployment vehicle moves down the wellbore. The optical fiber may be paid out from the surface or from a coil in the deployment vehicle. Gravity-based deployment vehicles may also be utilized when pumping into horizontal well bores.

Other types of fiber optic sensors may include point sensors either at the surface or downhole. Single point or multi-point pressure and temperature sensors may be used in reservoir monitoring applications, where the pressure sensors may be capable of collecting data at rates up to 2,000 Hz or even higher.

The fiber optic cables may also house one or several optical fibers. The optical fibers can also include single mode fibers, multi-mode fibers, or a combination of single mode and multi-mode optical fibers. The fiber optic sensing systems connected to the optical fibers can include Distributed Temperature Sensing (DTS) systems, Distributed Acoustic Sensing (DAS) Systems, Distributed Strain Sensing (DSS) Systems, quasi-distributed sensing systems where multiple single point sensors are distributed along an optical fiber/cable, or single point sensing systems where the sensors are located at the end of the cable.

The fiber optic sensing systems can operate using various sensing principles such as Rayleigh scattering, Brillouin scattering, Raman scattering including but not limited to amplitude-based sensing systems such as DTS systems based on Raman scattering, phase sensing based systems such as DAS systems based on interferometric sensing using homodyne or heterodyne techniques where the system may sense phase or intensity changes due to constructive or destructive interference, strain sensing systems such as DSS using dynamic strain measurements based on interferometric sensors or static strain sensing measurements using, for example, Brillouin scattering, quasi-distributed sensors based on Fiber Bragg Gratings (FBGs) where a wavelength shift can be detected or multiple FBGs are used to form Fabry-Perot type interferometric sensors for phase or intensity based sensing, or single point fiber optic sensors based on Fabry-Perot, FBG, or intensity-based sensors.

True Distributed Fiber Optic Sensing (DFOS) systems can also be utilized and based on Optical Time Domain Reflectometry (OTDR) principles or Optical Frequency Domain Reflectometry (OFDR). OTDR-based systems are pulsed where one or more optical pulses can be transmitted down an optical fiber and backscattered light (e.g., Rayleigh, Brillouin, Raman, etc.) is measured and processed. Time of flight for the optical pulses can indicate where along the optical fiber the measurement is performed. OFDR-based systems can operate in continuous wave (CW) mode where a tunable laser is swept across a wavelength range, and the back scattered light is collected and processed.

Various hybrid approaches can also include single point, quasi-distributed, or a combination of distributed fiber optic sensors such as electrical sensors. The fiber optic cable can also include optical fibers and electrical conductors. Electrical sensors can include pressure sensors based on quarts type sensors, strain gauge based sensors, or any other sensing technology suitable for the intended purpose and understood by a person of ordinary skill in the art. Pressure sensors, optical or electrical, can be housed in dedicated gauge mandrels, attached outside the casing in various configurations for down-hole deployment, or deployed at the surface well head or flow lines.

Temperature measurements received from a DTS system can be used to determine locations for water injection applications where fluid inflow in the treatment well, as well as the fluids from the surface, are likely to be cooler than formation temperatures. DTS warm-back analyses can determine fluid volume placement. This can be performed for water injection wells and fracturing fluid placement. Temperature measurements in observation wells can be used to determine fluid communication between the treatment well and the observation well, or to determine formation fluid movement.

DAS data can be used to determine fluid allocation in real-time as acoustic noise is generated when fluid flows through the casing and in through perforations into the formation. Phase and intensity based interferometric sensing systems are sensitive to temperature and mechanical, as well as acoustically induced vibrations. DAS data can be converted from time series data to frequency domain data using Fast Fourier Transforms (FFT) and other transforms (e.g., wavelet transforms can be utilized to generate different representations of the data). Various frequency ranges can be used for different purposes, and data can be averaged in time and/or space to improve Signal to Noise Ratios (SNR) of the various signals. Low frequency signal changes can be attributed to formation strain changes. Temperature changes can be due to fluid movement. Other frequency ranges can also be indicative of fluid or gas movement. Various filtering techniques and models can be applied to generate indicators of events that may be of interest. Indicators can include formation movement due to growing natural fractures, formation stress changes during the fracturing operations (e.g., stress shadowing), fluid seepage during the fracturing operation as formation movement can force fluid into an observation well that can be detected, fluid flow from fractures, and fluid and proppant flow from fracture hits. Each indicator can have a characteristic signature in terms of frequency content, amplitude, and/or time dependent behavior. These indicators can also be present at other data types and not limited to DAS data. Fiber optic cables used with DAS systems can include enhanced back scatter optical fibers where the Rayleigh backscatter can be increased by 10× or more with associated increases in Optical Signal to Noise Ratio (OSNR).

DAS systems can also be used to detect various seismic events where stress fields and growing fracture networks generate microseismic events or where perforation charge events may be used to determine travel time between horizontal wells. The detected data can also be used stage-to-stage to determine changes in travel time as the formation is fractured and filled with fluid and proppant. The DAS systems can also be used with surface seismic sources to generate Vertical Seismic Profiles (VSPs) before, during, and after a fracturing job to determine the effectiveness of the fracturing job as well as to determine production effectiveness. VSPs and reflection seismic surveys can be used over the life of a well or reservoir to track production related depletion and water, gas, and polymer flood fronts.

DSS data can be generated using various approaches. For example, static strain data can be used to determine absolute strain changes over time. Static strain data can be measured using Brillouin-based systems or quasi-distributed strain data from a FBG-based system. Static strain can also be used to determine propped fracture volume by looking at deviations in strain data from a measured strain baseline before fracturing a stage. Formation properties such as permeability, poroelastic responses, and leak off rates can be determined based on the change of strain versus time and the rate at which the strain changes over time. Dynamic strain data can be used in real-time to detect fracture growth through a corresponding inversion model and appropriate actions such as dynamic changes to fluid flow rates in the treatment well. Additional diverters or chemicals into the fracturing fluid, or changes to proppant concentrations or types can then be used to mitigate detrimental effects.

Fiber Bragg Grating based systems can also be used for a number of different measurements. FBGs can include partial reflectors that can be used as temperature and strain sensors, or can be used to make various interferometric sensors with very high sensitivity. FBGs can also be used to make point sensors or quasi-distributed sensors where FBG-based sensors can be used independently or with other types of fiber optic based sensors. FBGs can be manufactured into an optical fiber at a specific wavelength and other system such as DAS, DSS, or DTS systems, which may operate at different wavelengths in the same fiber and measure different parameters simultaneously as FBG-based systems use Wavelength Division Multiplexing (WDM) and/or Time Division Multiplexing (TDM).

In some implementations, the sensors can be positioned in either the injection wells or the production wells to measure reservoir level data of interest. For hydraulic fracturing wells, this can include treatment well pressure, rate, proppant concentration, diverters, fluids, and chemicals that may be altered to change the hydraulic fracturing treatment. These changes may impact the formation responses in several different ways such as changing stress fields. This may generate microseismic effects that can be measured with the DAS systems and the single point seismic sensors such as geophones. Fracture growth rates can change and this can generate changes in measured microseismic events and event distributions over time, or changes in measured strain using the low frequency portion, the DAS signal, or Brillouin-based sensing systems. Pressure changes can also be due to poroelastic effects that can be measured in the monitoring well. Pressure data can be measured in the treatment well and correlated to formation responses. Various changes in treatment rates and pressure may generate events that can be correlated to fracture growth rates.

All of the technologies and measurements outlined herein can be used for reservoir measurements in injection and production wells.

Several measurements can also be combined to determine adjacent well communication, and these measurements can further be used to change a hydraulic fracturing treatment schedule to generate desired outcomes. Multiple wells in a field or reservoir may include optical fibers for monitoring subsurface reservoirs from cradle to grave. Subsurface applications can include hydrocarbon extraction, geothermal energy production, and fluid injection such as water or $CO_2$ in carbon capture, utilization, and storage (CCUS) applications.

Figure 20:
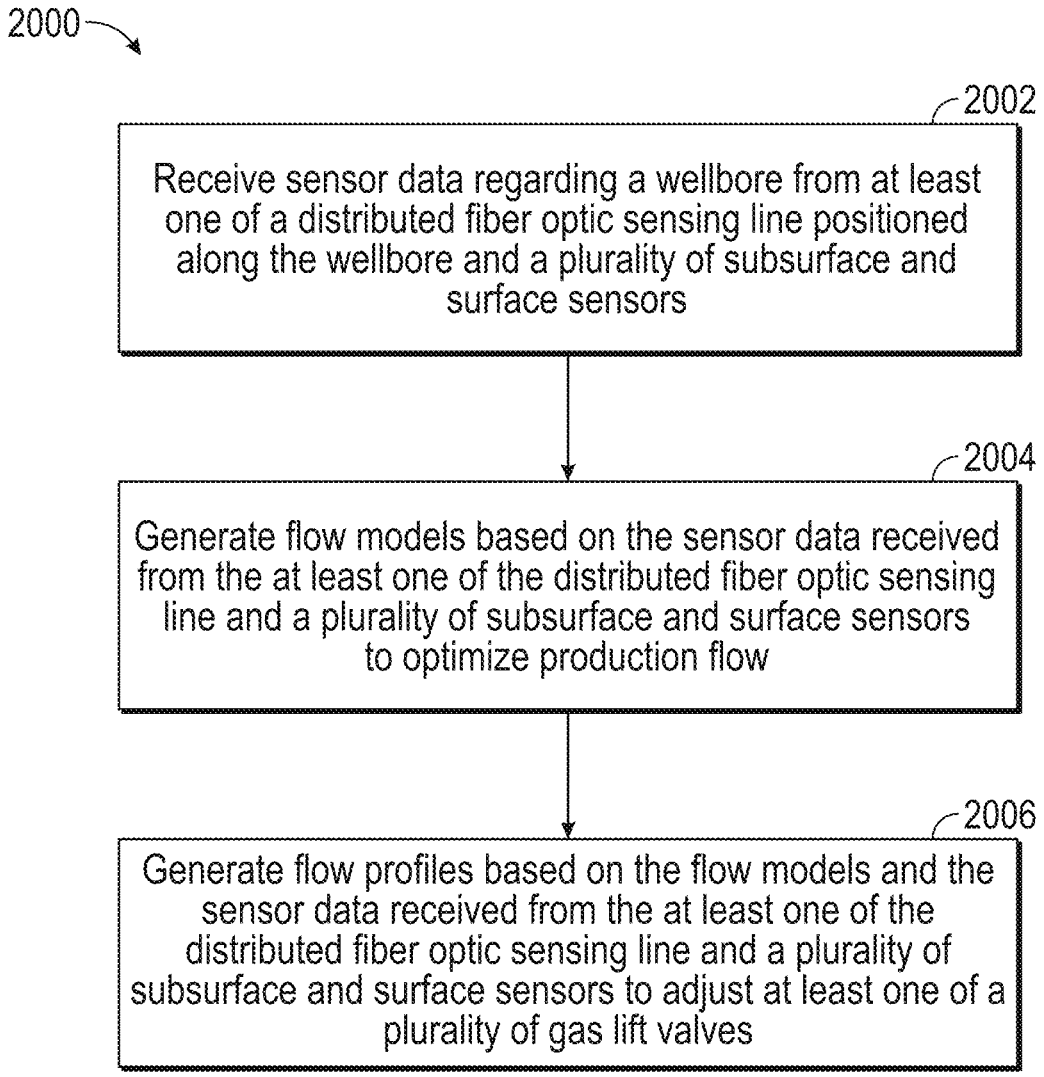
FIG. 20 shows an example process for generating data driven models, in accordance with aspects of the present disclosure.

Having disclosed some example system components and concepts, the disclosure now turns to FIG. 20, which illustrate example method 2000 for optimizing gas lift and gas lift valves by utilizing data driven in-situ injection. The steps outlined herein are exemplary and can be implemented in any combination thereof, including combinations that exclude, add, or modify certain steps.

At step 2002, the method 2000 includes receiving sensor data regarding a wellbore from at least one of a distributed fiber optic sensing line positioned along the wellbore and a plurality of subsurface and surface sensors. The sensor data can include at least one of surface flow meter data such as oil rate, water rate, and/or gas rate, pressure data, strain data, resistance data, acoustic data, temperature data, vibration data, and/or capacitance data.

At step 2004, the method 2000 includes generating flow models based on the sensor data received from the at least one of the distributed fiber optic sensing line and the plurality of subsurface and surface sensors to optimize production flow.

At step 2006, the method 2000 includes generating flow profiles based on the flow models and the sensor data received from the at least one of the distributed fiber optic sensing line and the plurality of subsurface and surface sensors to adjust at least one gas lift valve. In some examples, only one gas lift valve may be included. In some examples, a plurality of gas lift valves may be provided. In some examples, each of the gas lift valves are disposed down the wellbore in relation to each other. In adjusting the gas lift valve(s), lift gas pressure and/or rate can be changed.

In at least one example, the method 2000 can include determining which of the gas lift valves is operating. The method 2000 can include operating the gas lift valves sequential order down the wellbore until a final gas lift valve furthest downhole is operating while still maintaining the production of the wellbore within a target range.

In some examples, the method 2000 can include determining whether the flow profiles are within a target range. A set point option may be identified based on the determining of whether the flow profiles are within the target range. In some examples, the gas lift valves can be adjusted automatically based on the identified set point option.

In some examples, the method 2000 can include determining, based on the sensor data received from the at least one of a distributed fiber optic sensing line positioned along the wellbore and a plurality of subsurface and surface sensors, that at least one of the gas lift valves is malfunctioning. For example, the gas lift valve(s) may be leaking. The method 2000 then provides for fixing and/or replacing the at least one of the gas lift valves that is malfunctioning. The gas lift valve(s) to be fixed and/or replaced can be accurately identified by determining the location of the gas lift valve within the wellbore using sensor data received from the at least one of a distributed fiber optic sensing line positioned along the wellbore and a plurality of subsurface and surface sensors.

Figure 21:
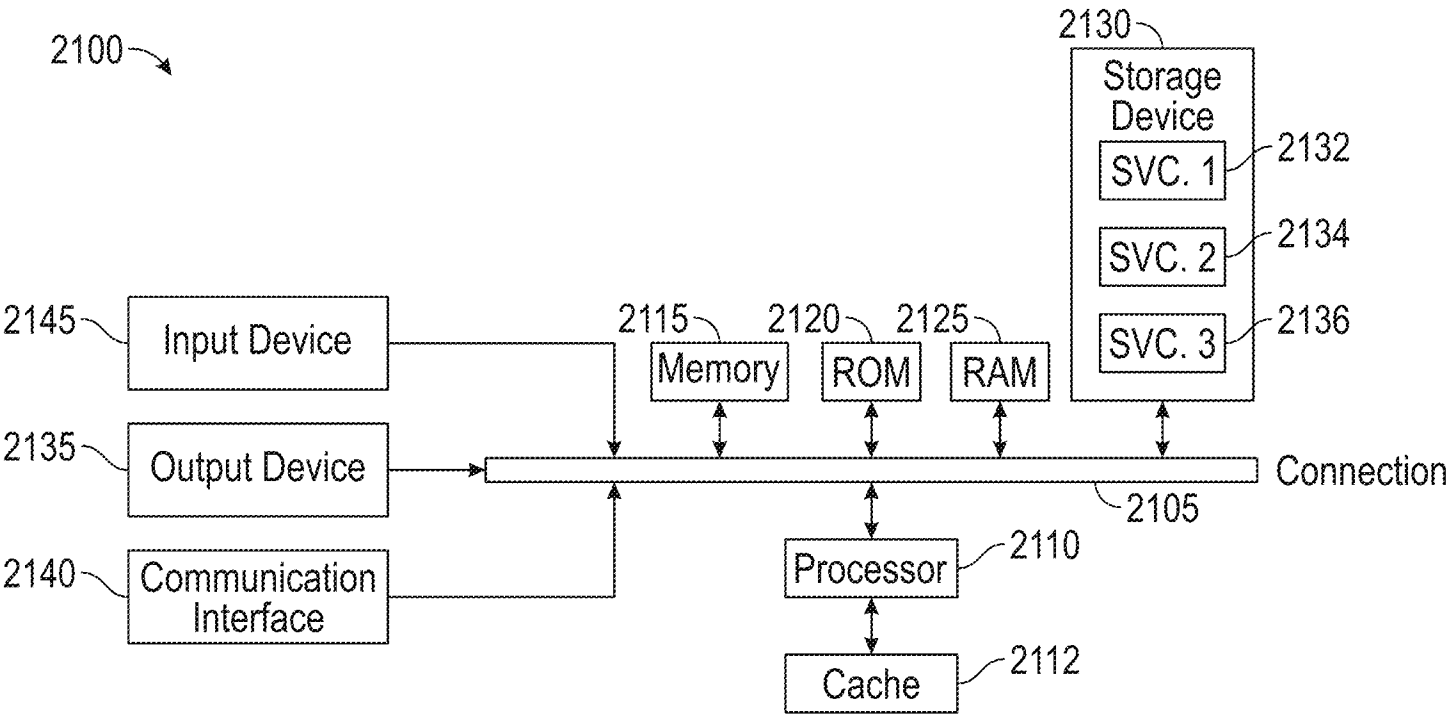
FIG. 21 illustrates an example computing device architecture that can be employed to perform various steps, methods, and techniques disclosed herein.

FIG. 21 illustrates an example computing device architecture 2100, which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 21 illustrates an example computing device architecture 2100 of a computing device, which can implement the various technologies and techniques described herein. The components of the computing device architecture 2100 are shown in electrical communication with each other using a connection 2105, such as a bus. The example computing device architecture 2100 includes a processing unit (CPU or processor) 2110 and a computing device connection 2105 that couples various computing device components including the computing device memory 2115, such as read only memory (ROM) 2120 and random access memory (RAM) 2125, to the processor 2110.

The computing device architecture 2100 can include a cache of high-speed memory connected directly with, in close proximity to, or integrated as part of the processor 2110. The computing device architecture 2100 can copy data from the memory 2115 and/or the storage device 2130 to the cache 2112 for quick access by the processor 2110. In this way, the cache can provide a performance boost that avoids processor 2110 delays while waiting for data. These and other modules can control or be configured to control the processor 2110 to perform various actions. Other computing device memory 2115 may be available for use as well. The memory 2115 can include multiple different types of memory with different performance characteristics. The processor 2110 can include any general purpose processor and a hardware or software service, such as service 1 2132, service 2 2134, and service 3 2136 stored in storage device 2130, configured to control the processor 2110 as well as a special-purpose processor where software instructions are incorporated into the processor design. The processor 2110 may be a self-contained system, containing multiple cores or processors, a bus, memory controller, cache, etc. A multi-core processor may be symmetric or asymmetric.

To enable user interaction with the computing device architecture 2100, an input device 2145 can represent any number of input mechanisms, such as a microphone for speech, a touch-sensitive screen for gesture or grail input, keyboard, mouse, motion input, speech and so forth. An output device 2135 can also be one or more of a number of output mechanisms known to those of skill in the art, such as a display, projector, television, speaker device, etc. In some instances, multimodal computing devices can enable a user to provide multiple types of input to communicate with the computing device architecture 2100. The communications interface 2140 can generally govern and manage the user input and computing device output. There is no restriction on operating on any particular hardware arrangement and therefore the basic features here may easily be substituted for improved hardware or firmware arrangements as they are developed.

Storage device 2130 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 2125, read only memory (ROM) 2120, and hybrids thereof. The storage device 2130 can include services 2132, 2134, 2136 for controlling the processor 2110. Other hardware or software modules are contemplated. The storage device 2130 can be connected to the computing device connection 2105. In one aspect, a hardware module that performs a particular function can include the software component stored in a computer-readable medium in connection with the necessary hardware components, such as the processor 2110, connection 2105, output device 2135, and so forth, to carry out the function.

As understood by those of skill in the art, machine-learning based classification techniques can vary depending on the desired implementation. For example, machine-learning classification schemes can utilize one or more of the following, alone or in combination: hidden Markov models; recurrent neural networks; convolutional neural networks (CNNs); deep learning; Bayesian symbolic methods; general adversarial networks (GANs); support vector machines; image registration methods; applicable rule-based system. Where regression algorithms are used, they may include including but are not limited to: a Stochastic Gradient Descent Regressor, and/or a Passive Aggressive Regressor, etc.

Machine learning classification models can also be based on clustering algorithms (e.g., a Mini-batch K-means clustering algorithm), a recommendation algorithm (e.g., a Minimwise Hashing algorithm, or Euclidean Locality-Sensitive Hashing (LSH) algorithm), and/or an anomaly detection algorithm, such as a Local outlier factor. Additionally, machine-learning models can employ a dimensionality reduction approach, such as, one or more of: a Mini-batch Dictionary Learning algorithm, an Incremental Principal Component Analysis (PCA) algorithm, a Latent Dirichlet Allocation algorithm, and/or a Mini-batch K-means algorithm, etc.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data, which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A method is disclosed comprising: receiving sensor data regarding a wellbore from at least one of a distributed fiber optic sensing line positioned along the wellbore and a plurality of subsurface and surface sensors; generating flow models based on the sensor data received from the at least one of the distributed fiber optic sensing line and the plurality of subsurface and surface sensors to optimize production flow; and generating flow profiles based on the flow models and the sensor data received from the at least one of the distributed fiber optic sensing line and the plurality of subsurface and surface sensors to adjust at least one gas lift valve.

Statement 2: A method is disclosed according to Statement 1, wherein the sensor data includes at least one of surface flow meter data, pressure data, strain data, resistance data, acoustic data, temperature data, vibration data, and/or capacitance data.

Statement 3: A method is disclosed according to Statements 1 or 2, wherein each of the gas lift valves are disposed down the wellbore in relation to each other.

Statement 4: A method is disclosed according to Statement 3, further comprising determining which of the gas lift valves is operating.

Statement 5: A method is disclosed according to Statement 4, further comprising: operating the gas lift valves in sequential order down the wellbore until a final gas lift valve further downhole is operating while still maintaining the production of the wellbore within a target range.

Statement 6: A method is disclosed according to any of Statements 1-5, further comprising: determining whether the flow profiles are within a target range; identifying a set point option based on the determining of whether the flow profiles are within the target range; and adjusting the gas lift valves automatically based on the identified set point option.

Statement 7: A method is disclosed according to any of Statements 1-6, further comprising: determining, based on the sensor data received from the at least one of a distributed fiber optic sensing line positioned along the wellbore and a plurality of subsurface and surface sensors, that at least one of the gas lift valves is malfunctioning.

Statement 8: A system is disclosed comprising: a tubing disposed in a wellbore including at least one gas lift valve; at least one of a distributed fiber optic sensing line positioned along the wellbore and a plurality of subsurface and surface sensors; one or more processors; and at least one computer-readable storage medium having stored therein instructions which, when executed by the one or more processors, cause the system to: receive sensor data from the at least one of a distributed fiber optic sensing line positioned along a wellbore and a plurality of subsurface and surface sensors; generate flow models based on the sensor data received from the at least one of the distributed fiber optic sensing line and the plurality of subsurface and surface sensors to optimize production flow; and generate flow profiles based on the flow models and the sensor data received from the at least one of the distributed fiber optic sensing line and the plurality of subsurface and surface sensors to adjust at least one of the gas lift valves.

Statement 9: A system is disclosed according to Statement 8, wherein the sensor data includes at least one of surface flow meter data, pressure data, strain data, resistance data, acoustic data, temperature data, vibration data, and capacitance data.

Statement 10: A system is disclosed according to Statements 8 or 9, wherein each of the gas lift valves are disposed down the wellbore in relation to each other.

Statement 11: A system is disclosed according to Statement 10, wherein the instructions, when executed by the one or more processors, further cause the system to: determine which of the gas lift valves is operating.

Statement 12: A system is disclosed according to Statement 11, wherein the instructions, when executed by the one or more processors, further cause the system to: operate the gas lift valves in sequential order down the wellbore until a final gas lift valve furthest downhole is operating while still maintaining the production of the wellbore within a target range.

Statement 13: A system is disclosed according to any of preceding Statements 8-12, wherein the instructions, when executed by the one or more processors, further cause the system to: determine whether the flow profiles are within a target range; identify a set point option based on the determining of whether the flow profiles are within the target range; and adjust the gas lift valves automatically based on the identified set point option.

Statement 14: A system is disclosed according to any of preceding Statements 8-13, wherein the instructions, when executed by the one or more processors, further cause the system to: determine, based on the sensor data received from the at least one of a distributed fiber optic sensing line positioned along the wellbore and a plurality of subsurface and surface sensors, that at least one of the gas lift valves is malfunctioning.

Statement 15: A non-transitory computer-readable storage medium is disclosed comprising: instructions stored on the non-transitory computer-readable storage medium, the instructions, when executed by one or more processors, cause the one or more processors to: receive sensor data regarding a wellbore from at least one of the distributed fiber optic sensing line positioned along the wellbore and a plurality of subsurface and surface sensors; generate flow models based on the sensor data received from the at least one of the distributed fiber optic sensing line and the plurality of subsurface and surface sensors to optimize production flow; and generate flow profiles based on the flow models and the sensor data received from the at least one of the distributed fiber optic sensing line and the plurality of subsurface and surface sensors to adjust at least one gas lift valve.

Statement 16: A non-transitory computer-readable storage medium is disclosed according to Statement 15, wherein each of the gas lift valves are disposed down the wellbore in relation to each other.

Statement 17: A non-transitory computer-readable storage medium is disclosed according to Statement 16, wherein the instructions, when executed by the one or more processors, further cause the one or more processors to: determine which of the gas lift valves is operating.

Statement 18: A non-transitory computer-readable storage medium is disclosed according to Statement 17, wherein the instructions, when executed by the one or more processors, further cause the one or more processors to: operate the gas lift valves in sequential order down the wellbore until a final gas lift valve further downhole is operating while still maintaining the production of the wellbore within a target range.

Statement 19: A non-transitory computer-readable storage medium is disclosed according to any of preceding Statements 15-18, wherein the instructions, when executed by the one or more processors, further cause the one or more processors to: determine whether the flow profiles are within a target range; identify a set point option based on the determining of whether the flow profiles are within the target range; and adjust the gas lift valves automatically based on the identified set point option.

Statement 20: A non-transitory computer-readable storage medium is disclosed according to any of preceding Statements 15-19, wherein the instructions, when executed by the one or more processors, further cause the one or more processors to: determine, based on the sensor data received from the at least one of a distributed fiber optic sensing line positioned along the wellbore and a plurality of subsurface and surface sensors, that at least one of the gas lift valves is malfunctioning.

What is claimed is:

1. A method comprising:

adjusting input control variables that control at least one gas lift setting or flow control device setting as part of a machine learning process;

receiving sensor data regarding a wellbore from at least one of a distributed fiber optic sensing line positioned along the wellbore and a plurality of subsurface and surface sensors regarding a plurality of gas lift valves when the input control variables are adjusted to control the at least one gas lift setting or the flow control device setting;

identifying a set of signatures from the sensor data received from the at least one of the distributed fiber optic sensing line and the plurality of subsurface and surface sensors;

generating a data driven flow model based on the sensor data being applied to the machine learning process;

generating a production profile based on operation of the data driven flow model, the production profile associated with a plurality of production zones of the wellbore and operation of the plurality of gas lift valves;

identifying, based at least in part on the set of signatures, that a flow associated with an inflow device of a specific zone of the plurality of production zones does not correspond to a target range of the production profile;

adjusting the inflow device of the specific zone to update the flow to correspond to the target range of the production profile based on the input control variables that control the at least one gas lift setting or the flow control device setting;

comparing measurement data sensed by the at least one of the distributed fiber optic sensing and the plurality of subsurface and surface sensors with the set of signatures; and identifying that a first gas lift valve of the plurality of gas lift valves has malfunctioned based on the comparison of the measurement data with the set of signatures.

2. The method of claim 1, further comprising:

monitoring a reservoir level pressure associated with the production profile; and making an adjustment to maintain the reservoir level pressure associated with the production profile based on application of the data driven flow model.

3. The method of claim 1, further comprising:

determining which of the plurality of gas lift valves is operating.

4. The method of claim 3, further comprising:

operating the plurality of gas lift valves in sequential order down the wellbore until a final gas lift valve furthest downhole is operating while production of the wellbore is maintained within the target range of the production profile.

5. The method of claim 1, further comprising:

determining that the production profile is within the target range;

identifying a set point option based on the determination that the production profile is within the target range; and adjusting the plurality of gas lift valves automatically based on the identified set point option.

6. The method of claim 1, wherein at least one of the data driven flow model or the production profile is generated using a machine learning based classification technique applied on the input control variables and measured well production of each of the plurality of production zones.

7. The method of claim 6, wherein a second data driven flow model is generated after restarting a calibration process.

8. The method of claim 1, wherein:

the input control variables are adjusted by increasing and decreasing settings of the input control variables to prevent a systematic error associated with the input control variables.

9. The method of claim 1, further comprising:

identifying an acoustic signature of the set of signatures;

identifying a temperature signature of the set of signatures; and comparing the flow associated with the inflow device with the target range of the production profile, wherein the identification that the flow associated with the inflow device of the specific zone of the plurality of production zones does not correspond to the target range of the production profile is also based on the acoustic signature and the temperature signature.

10. The method of claim 1, further comprising:

receiving baseline sensor data from the at least one of the distributed fiber optic sensing line positioned along the wellbore and the plurality of subsurface and surface sensors before;

identifying a well production baseline profile and a well shut in baseline profile from the baseline sensor data;

identifying a deviation from the well production baseline profile and the well shut in baseline profile in relation to an injection profile, wherein the identification that the first gas lift valve has malfunctioned is also based on the deviation from the well production baseline profile and the well shut in baseline profile in relation to the injection profile.

11. A system comprising:

a tubing disposed in a wellbore;

a plurality of gas lift valves;

an inflow device of a specific zone of a plurality of production zones;

at least one of a distributed fiber optic sensing line positioned along the wellbore and a plurality of subsurface and surface sensors;

one or more processors; and at least one memory that stores instructions which, when executed by the one or more processors, cause the system to:

adjust input control variables that control at least one gas lift setting or flow control device setting as part of a machine learning process;

receive sensor data from the at least one of the distributed fiber optic sensing line positioned along the wellbore and the plurality of subsurface and surface sensors regarding the plurality of gas lift valves when the input control variables are adjusted to control the at least one gas lift setting or the flow control device setting;

identify set of signatures from the sensor data received from the at least one of the distributed fiber optic sensing line and the plurality of subsurface and surface sensors;

generate a data driven flow model based on the sensor data being applied to the machine learning process;

generate a production profile based on operation the data driven flow model, the production profile associated with operation of the plurality of gas lift valves;

identify, based at least in part on the set of signatures, that a flow associated with the inflow device of the specific zone of the plurality of production zones does not correspond to a target range of the production profile;

adjust the inflow device of the specific zone to update the flow to correspond to the target range of the production profile based on the input control variables that control the at least one gas lift setting or the flow control device setting;

compare measurement data sensed by the at least one of the distributed fiber optic sensing and the plurality of subsurface and surface sensors with the set of signatures; and identify that a first gas lift valve of the plurality of gas lift valves has malfunctioned based on the comparison of the measurement data with the set of signatures.

12. The system of claim 11, wherein the plurality of processors execute the instructions to:

monitor a reservoir level pressure associated with the production profile; and make an adjustment to maintain the reservoir level pressure associated with the production profile based on application of the data driven flow model.

13. The system of claim 11, wherein the one or more processors execute the instructions to determine which of the plurality of gas lift valves is operating.

14. The system of claim 13, wherein the one or more processors execute the instructions to control operation of the plurality of gas lift valves in sequential order down the wellbore until a final gas lift valve furthest downhole is operating while production of the wellbore is maintained within the target range of the production profile.

15. The system of claim 11, wherein the one or more processors execute the instructions to:

determine that the production profile is within the target range;

identify a set point option based on the determination that the production profile is within the target range; and adjust the plurality of gas lift valves automatically based on the identified set point option.

16. The system of claim 11, wherein at least one of the data driven flow model or the production profile is generated using a machine learning based classification technique applied on the input control variables and measured well production of each of the plurality of production zones.

17. The system of claim 16, wherein a second data driven flow model is generated after restarting a calibration process.

18. A non-transitory computer-readable storage medium having embodied thereon instructions that when executed by one or more processors cause the one or more processors to:

adjust input control variables that control at least one gas lift setting or flow control device setting as part of a machine learning process;

receive sensor data regarding a wellbore from at least one of a distributed fiber optic sensing line positioned along the wellbore and a plurality of subsurface and surface sensors regarding a plurality of gas lift valves when the input control variables are adjusted to control the at least one gas lift setting or the flow control device setting;

identify a set of signatures from the sensor data received from the at least one of the distributed fiber optic sensing line and the plurality of subsurface and surface sensors;

generate a data driven flow model based on the sensor data being applied to the machine learning process;

generate a production profile based on operation of the data driven flow model, the production profile associated with a plurality of production zones of the wellbore and operation of the plurality of gas lift valves;

identify, based at least in part on the set of signatures, that a flow associated with an inflow device of a specific zone of the plurality of production zones does not correspond to a target range of the production profile;

adjust the inflow device of the specific zone to update the flow to correspond to the target range of the production profile based on the input control variables that control the at least one gas lift setting or the flow control device setting;

compare measurement data sensed by the at least one of the distributed fiber optic sensing and the plurality of subsurface and surface sensors with the set of signatures; and identify that a first gas lift valve of the plurality of gas lift valves has malfunctioned based on the comparison of the measurement data with the set of signatures.

19. The non-transitory computer-readable storage medium of claim 18, wherein the one or more processors execute the instructions to:

monitor a reservoir level pressure associated with the production profile; and make an adjustment to maintain the reservoir level pressure associated with the production profile based on application of the data driven flow model.

20. The non-transitory computer-readable storage medium of claim 18, wherein the one or more processors execute the instructions to control operation of the plurality of gas lift valves in sequential order down the wellbore until a final gas lift valve furthest downhole is operating while production of the wellbore is maintained within the target range of the production profile.

21. The non-transitory computer-readable storage medium of claim 18, wherein the one or more processors execute the instructions to:

determine that the production profile is within the target range;

identify a set point option based on the determination that the production profile is within the target range; and adjust the plurality of gas lift valves automatically based on the identified set point option.

22. The non-transitory computer-readable storage medium of claim 18, wherein the one or more processors execute the instructions to determine, based on the sensor data received from the at least one of the distributed fiber optic sensing line positioned along the wellbore and the plurality of subsurface and surface sensors, that at least one of the plurality of gas lift valves is malfunctioning.

23. The non-transitory computer-readable storage medium of claim 18, wherein at least one of the data driven flow model or the production profile is generated using a machine learning based classification technique applied on the input control variables and measured well production of each of the plurality of production zones.

24. The non-transitory computer-readable storage medium of claim 23, wherein a second data driven flow model is generated after restarting a calibration process.

* * * * *